US008777690B2

(12) United States Patent
Zhou et al.

(10) Patent No.: US 8,777,690 B2
(45) Date of Patent: Jul. 15, 2014

(54) EXPANDABLE PLAYSET WITH MOVABLE PLATFORM AND DOLL DRESSING FEATURE

(75) Inventors: Peng Zhou, Shenzhen (CN); Sheng Hua Tang, Shenzhen (CN); Yu Sun Chiu, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 356 days.

(21) Appl. No.: 13/212,333

(22) Filed: Aug. 18, 2011

(65) Prior Publication Data

US 2012/0045965 A1 Feb. 23, 2012

Related U.S. Application Data

(60) Provisional application No. 61/374,824, filed on Aug. 18, 2010.

(51) Int. Cl.
*A63H 3/52* (2006.01)
*A63H 33/00* (2006.01)

(52) U.S. Cl.
CPC ..... *A63H 3/52* (2013.01)
USPC ..... 446/478; 446/489

(58) Field of Classification Search
USPC ..... 446/71–73, 132, 135, 268, 308–312, 446/476–478, 489; 40/411, 415
See application file for complete search history.

(56) References Cited

U.S. PATENT DOCUMENTS 1,232,601 A 7/1917 Pente
1,330,043 A 2/1920 Offutt
2,682,727 A 7/1954 Keljik
2,715,793 A * 8/1955 Strauss ..... 446/237
2,774,181 A * 12/1956 Cowen ..... 446/314
2,872,753 A 2/1959 Fenton
2,944,368 A 7/1960 O'Brian et al.
3,182,420 A 5/1965 Bender
3,457,668 A * 7/1969 Genin ..... 446/423
3,592,469 A 7/1971 Glass et al.
3,675,362 A * 7/1972 DE Gelder et al. ..... 446/83
3,783,554 A 1/1974 Shapero
3,849,930 A 11/1974 Stubbmann
3,916,548 A * 11/1975 Langer ..... 40/409
3,946,520 A * 3/1976 Goldfarb et al. ..... 446/135
4,018,001 A 4/1977 Walmer
4,030,235 A 6/1977 Terzian et al.
4,112,610 A * 9/1978 Sano ..... 446/423
4,139,967 A * 2/1979 Kuna et al. ..... 446/241
4,161,081 A 7/1979 Katzman et al.

(Continued)

FOREIGN PATENT DOCUMENTS

GB 2159721 A 12/1985

*Primary Examiner* — Gene Kim
*Assistant Examiner* — Alyssa Hylinski
(74) *Attorney, Agent, or Firm* — Edell, Shapiro & Finnan LLC

(57) ABSTRACT

A playset includes a housing defining a chamber, and first and second openings in communication with the chamber. A platform is coupled to the housing and movable in opposing first and second directions through the first opening, and in opposing third and fourth directions through the second opening. A doll is coupleable to the platform and rotatable about an axis between first and second positions relative to the platform. The doll is moved from the first position to the second position as the platform is moved in the second direction, and the doll is moved from the second position to the first position as the platform is moved in the third direction.

20 Claims, 19 Drawing Sheets

(56) References Cited

U.S. PATENT DOCUMENTS

| | | | | | |
|---|---|---|---|---|---|
| 4,165,579 | A | | 8/1979 | Chase | |
| 4,219,960 | A | | 9/1980 | Walmer et al. | |
| 4,233,778 | A | | 11/1980 | Lemelson | |
| 4,356,658 | A | * | 11/1982 | Goldfarb | 446/83 |
| 4,595,378 | A | | 6/1986 | Sweet et al. | |
| 4,883,443 | A | | 11/1989 | Chase | |
| 4,925,423 | A | | 5/1990 | Miller et al. | |
| 5,328,400 | A | | 7/1994 | Bass | |
| 5,412,890 | A | * | 5/1995 | Fechter | 40/414 |
| 5,480,341 | A | | 1/1996 | Plakos | |
| 5,558,555 | A | * | 9/1996 | Kennedy | 446/359 |
| 5,601,471 | A | * | 2/1997 | Kennedy | 446/236 |
| 6,475,054 | B1 | | 11/2002 | Liu | |
| 6,565,413 | B2 | | 5/2003 | Brownrigg | |
| 6,568,986 | B2 | | 5/2003 | Kobayashi | |
| 6,638,135 | B2 | * | 10/2003 | Fong | 446/242 |
| 7,371,148 | B2 | * | 5/2008 | Marine et al. | 446/476 |
| 7,448,932 | B2 | * | 11/2008 | Buckley et al. | 446/83 |
| 8,465,336 | B2 | * | 6/2013 | Byrd | 446/69 |
| 2003/0176143 | A1 | | 9/2003 | Ruiz Gonzalez | |
| 2006/0014472 | A1 | | 1/2006 | Spielberger | |
| 2006/0099876 | A1 | * | 5/2006 | Buckley et al. | 446/83 |
| 2006/0286891 | A1 | | 12/2006 | Knight et al. | |
| 2007/0093171 | A1 | * | 4/2007 | Chan et al. | 446/268 |

* cited by examiner

EXPANDABLE PLAYSET WITH MOVABLE PLATFORM AND DOLL DRESSING FEATURE

CROSS REFERENCE TO RELATED APPLICATION AND CLAIM TO PRIORITY

The present application claims priority to and is based on U.S. Provisional Patent Application Ser. No. 61/374,824, filed Aug. 18, 2010, titled "Expandable Playset with Movable Platform and Doll Dressing Feature," the entire disclosure of which is incorporated herein by reference in its entirety.

FIELD OF THE INVENTION

The present invention relates to a playset, and in particular, to an expandable playset including a chamber for receiving a doll, and a platform movable into and out of the chamber along multiple planes relative to the chamber.

BACKGROUND OF THE INVENTION

Various dolls with clothing and accessories are known. Some dolls include removable clothing so that a doll's outfit may be selected and changed by a child. Playsets including toy wardrobes for retaining such accessories and clothing are also known. However, such conventional playsets provided limited mechanisms for moving the doll and/or reconfiguring the appearance of the doll.

It would be desirable to provide a playset which automatically moves a doll in multiple directions and/or which provides a unique mechanism for attaching articles to the doll.

SUMMARY OF THE INVENTION

The present invention is directed to a playset including a housing and a platform movably coupled to the housing. The housing defines a chamber, a first opening in communication with the chamber, and a second opening in communication with the chamber. The platform is movable along a first plane between a first position disposed within the chamber and a second position extending outwardly from the first opening of the chamber. The platform is also movable along a second plane between the first position and a third position proximate the second opening of the chamber. In one implementation, the first plane is substantially perpendicular to the second plane.

In one embodiment, the housing includes a bottom portion. The platform is coupled to the bottom portion when the platform moves between the first position and the second position. The platform is decoupled from the bottom portion when the platform moves from the first position to the third position. In one implementation, the housing further includes an end wall portion. The platform is coupled to the end wall portion when the platform moves between the first position and the third position.

In one embodiment, the platform includes an engagement member configured to releasably retain a doll. The engagement member is rotatable about an axis relative to the platform when the platform moves between the first position and the second position. In one embodiment, the axis of rotation of the engagement member is substantially perpendicular to the first plane.

In one embodiment, when the doll is retained on the engagement member, the doll faces a first direction when the platform is disposed in the second position, and the doll is rotated to face a second direction as the platform moves from the second position to the first position. In one implementation, the doll is rotated to face the first direction as the platform is moved from the first position to the third position. In one implementation, the engagement member is rotatable about 90° about the axis of rotation.

The present invention is also directed to a playset including a housing defining a chamber, a first opening in communication with the chamber, and a second opening in communication with the chamber. A platform is movably coupled to the housing. The platform is movable in opposing first and second directions through the first opening, and the platform is movable in opposing third and fourth directions through the second opening. A doll is coupleable to the platform and rotatable about an axis between a first position and a second position relative to the platform. The doll is moved from the first position to the second position as the platform is moved in the second direction, and the doll is moved from the second position to the first position as the platform is moved in the third direction.

In one embodiment, the doll is maintained in the first position when the platform is moved in the first direction immediately following movement in the fourth direction. In another embodiment, the doll is moved from the second position to the first position when the platform is moved in the first direction immediately following movement in the second direction.

In one embodiment, the doll faces the first direction when disposed in the first position, and the doll faces a fifth direction when disposed in the second position. In one implementation, the fifth direction is substantially perpendicular to the first direction.

In one embodiment, the playset further includes an article releasably attachable to the doll, and an attachment mechanism movably disposed within the chamber. The article is releasably coupleable to the attachment mechanism. The attachment mechanism is movable between a third position spaced from the doll and a fourth position proximate the doll when the doll is moved into the chamber from the second direction. The article is decoupleable from the attachment mechanism and attachable to the doll when the attachment mechanism is disposed in the fourth position. In one implementation, the doll is disposed in the second position when the attachment mechanism is disposed in the fourth position.

In one embodiment, the attachment mechanism includes first and second arms pivotally coupled to the housing and disposed on opposite sides of the platform. The first and second arms include distal end portions engageable with opposite sides of the doll.

In one embodiment, the playset further includes an actuator arm coupled to the platform. The platform is movable in the second direction and into the chamber via movement of the actuator arm in the second direction. The attachment mechanism is movable from the third position to the fourth position via movement of the actuator arm in the second direction. In one implementation, the platform is decoupled from the actuator arm when the platform is moved in the third direction.

The present invention is also directed to a playset including a base having an engagement area, a platform coupled to the base and movable into and out of the engagement area, a doll releasably retained on the platform, and an attachment mechanism coupled to the base and movable in to and out of the engagement area. An article is releasably attachable to the doll. The article is releasably coupleable to the attachment mechanism when the attachment mechanism is disposed out of the engagement area. The article is decoupleable from the attachment mechanism and attachable to the doll when the attachment mechanism is disposed in the engagement area. The doll faces in a first direction when the platform is disposed out of the engagement area. The doll faces in a second direction when the article is being attached to the doll via the attachment mechanism.

In one embodiment, the playset further includes a housing defining a chamber. A first opening is in communication with the chamber, and a second opening is in communication with the chamber. The engagement area is disposed within the chamber. In one implementation, the platform is movable into and out of the engagement area in opposing third and fourth directions and toward the first opening. The platform is movable into and out of the engagement area in opposing fifth and sixth directions and toward the second opening. In one implementation, the first direction is aligned with the fourth direction so that the doll is facing outwardly and away from the engagement area in the first direction.

In one embodiment, at least one door is coupled to the housing and movable between a closed position at least partially blocking the first opening and an open position allowing access to the first opening. The door moves from the closed position to the open position when the platform is moved in the fourth direction.

In one embodiment, the playset includes a support portion. The base is coupled to the support portion and movable between a lowered position adjacent the support portion and a raised position spaced from the support portion. In one embodiment, a side portion is also coupled to the support portion. The side portion is movable between a retracted position adjacent the support portion and an extended position spaced from the support portion.

In one implementation, a latch is provided that is configured to releasably retain the base in the lowered position and the side portion in the retracted position. Upon releasing the latch, the base moves to the raised position and the side portion simultaneously moves to the extended position.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
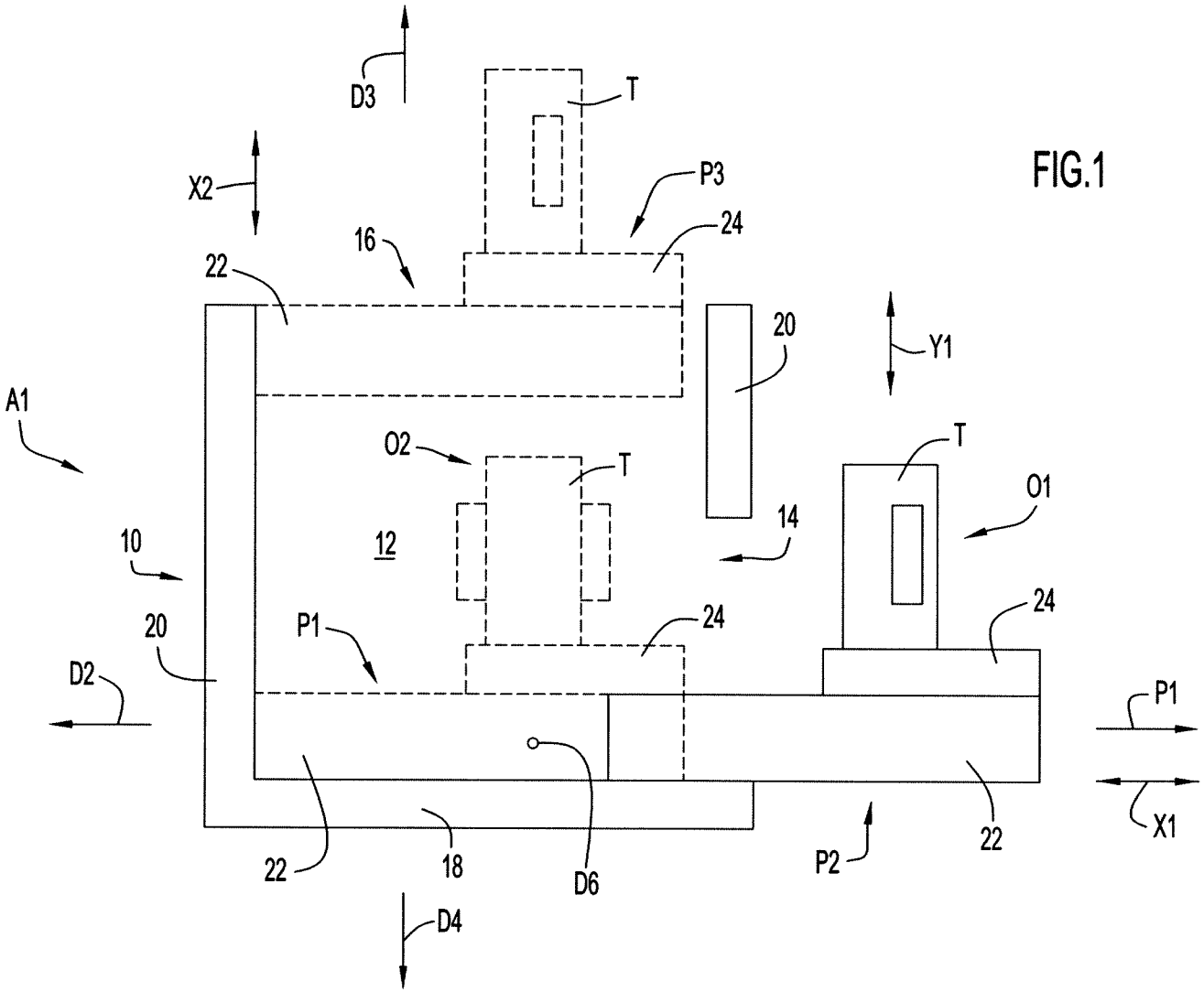
FIG. 1 illustrates a schematic diagram of a playset according to an embodiment of the present invention.

FIG. 1 illustrates a schematic diagram of a playset A1 according to an embodiment of the present invention. Playset A1 includes a housing 10 defining a chamber 12, a first opening 14 in communication with the chamber 12, and a second opening 16 in communication with the chamber 12. In one embodiment, the housing 10 includes a bottom portion 18 and a wall portion 20 coupled to and extending upwardly from the bottom portion 18.

A platform 22 is movably coupled to the housing 10. The platform 22 is movable in opposing directions D1, D2 and along a first plane X1 between a first position P1 (shown in phantom) disposed within the chamber 12 and a second position P2 extending outwardly from the first opening 14 of the chamber 12. The platform 22 is also movable in opposing directions D3, D4 and along a second plane X2 between the first position P1 and a third position P3 (also shown in phantom) proximate the second opening 16 of the chamber 12.

Thus, the platform 22 is movable from the first position P1 in direction D1 and toward or through the first opening 14 to the second position P2 out of the chamber 12. The platform 22 is also movable from the second position P2 in direction D2 back through the first opening to the first position P1 within in the chamber 12. Further, the platform 22 is movable from the first position P1 in direction D3 and toward or through the second opening 16 to the third position P3, and also movable from the third position P3 in direction D4 back to the first position P1 within the chamber 12. In one implementation, the first plane X1 is substantially perpendicular to the second plane X2. Accordingly, directions D1, D2 are substantially perpendicular to directions D3, D4.

In one embodiment, the platform 22 is coupled to the bottom portion 18 when the platform 22 moves between the first position P1 and the second position P2. The platform 22 decouples from the bottom portion 18 when the platform 22 moves from the first position P1 to the third position P3. The platform 22 is coupled to the wall portion 20 when the platform 22 moves between the first position P1 and the third position P3.

With continued reference to FIG. 1, in one embodiment, the platform 22 includes an engagement member 24 configured to releasably retain a toy, such as a doll T. The engagement member 24 is rotatable about an axis Y1 relative to the platform 22 when the platform 22 moves between the second position P2 and the first position P1 (and/or vice versa). In one embodiment, the axis of rotation Y1 of the engagement member 24 is substantially perpendicular to the first plane X1. In one implementation, the engagement member 24 is rotatable about 90° about the axis of rotation Y1.

Thus, when the doll T is retained on the engagement member 24, the doll T faces outwardly or away from the chamber 12 in direction D1, and is disposed in a forward facing orientation O1, when the platform 22 is disposed in the its second position P2. The doll T rotates about axis Y1 to face another direction D6 (into or out of FIG. 1), and is disposed in a side facing orientation O2, as the platform 22 moves in direction D2 from its second position P2 to its first position P1 within the chamber 12. In one implementation, direction D6 of the doll T is substantially perpendicular to direction D1. In one embodiment, the doll T is rotated back to its forward facing orientation O1 and facing in direction D1 as the platform 22 is moved in direction D3 from its first position P1 to its third position P3.

Figure 2:
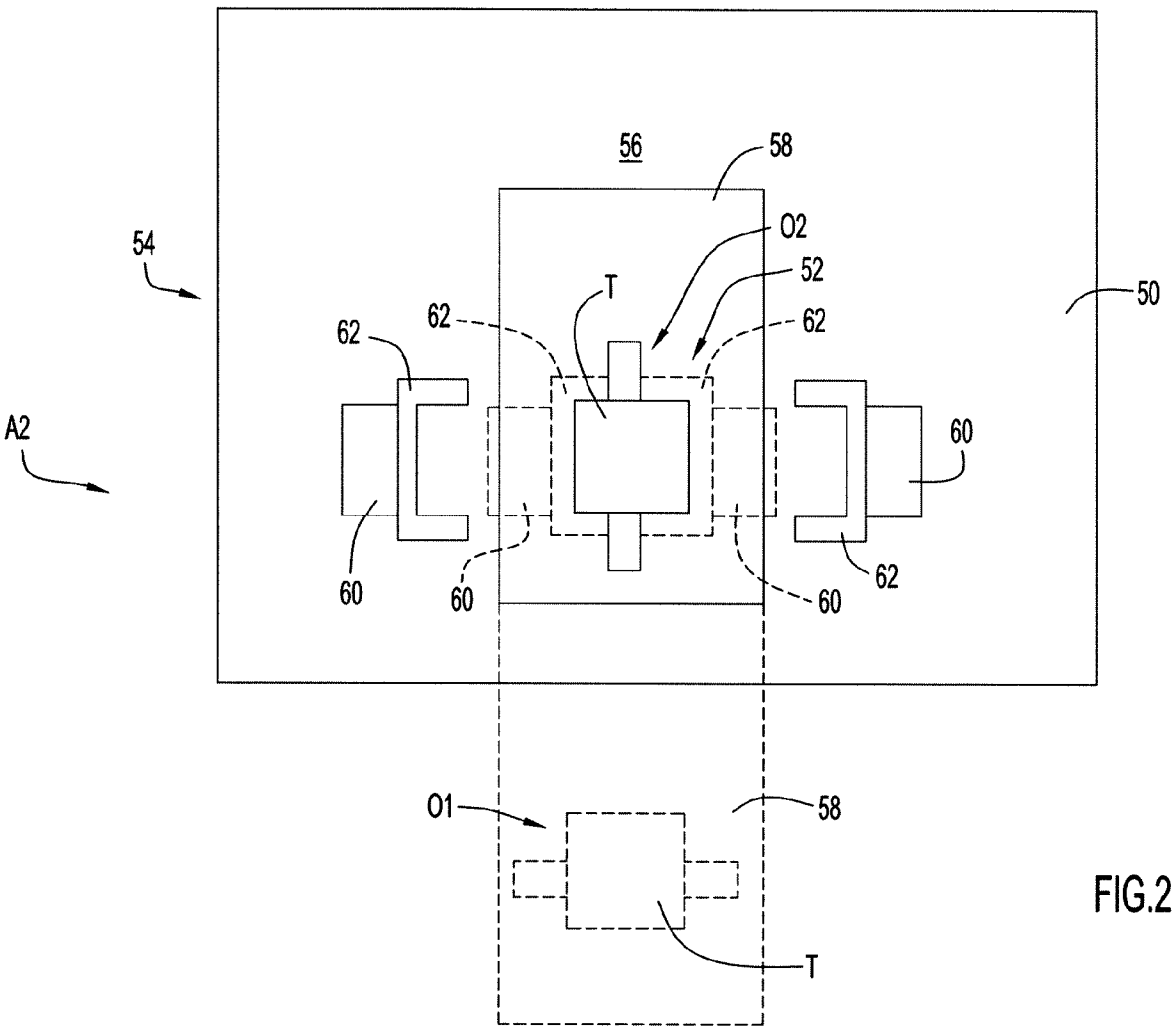
FIG. 2 illustrates a schematic diagram of a playset according to another embodiment.

FIG. 2 illustrates a schematic diagram of a playset A2 according to another embodiment. Playset A2 includes a base 50 including an engagement area 52. In one embodiment, the base 50 is a portion of a housing 54 defining a chamber 56. The housing 54 further defines first and second openings in communication with the chamber 56, as described above and as shown in FIG. 1. The engagement area 52 is disposed within the chamber 56. A platform 58 is coupled to the base 50 and movable into and out of the engagement area 52 (as shown in phantom). A toy, such as a doll T, is releasably retainable on the platform 58.

An attachment mechanism 60 is coupled to the base 50 and movable into and out of the engagement area 52 (as shown in phantom). An article 62 is releasably attachable to the doll T. In addition, the article 62 is releasably coupleable to the attachment mechanism 60 when the attachment mechanism 60 is disposed out of the engagement area 52. The article 62 may then be decoupled from the attachment mechanism 60 and attached to the doll T when the attachment mechanism 60 is disposed in the engagement area 52 (as shown in phantom). Referring to FIG. 2, each of the attachment mechanism 60 and the article 62 can include two portions that are moved relative to each other.

The doll T faces in a direction outwardly from the chamber 56 and is disposed in a forward facing orientation O1 when the platform 58 is disposed out of the engagement area 52 (as shown in phantom). The doll T is faces in another direction and is disposed in a side facing orientation O2 when the article 62 is being attached to the doll T via the attachment mechanism 60. The doll T may then be removed from the engagement area 52 by moving the platform 58 out of the engagement area 52. When the doll T is moved out of the engagement area 52, the doll T is rotated to again face in an outwardly direction away from the chamber 56 and is disposed in its forward facing orientation O1.

Figure 3:
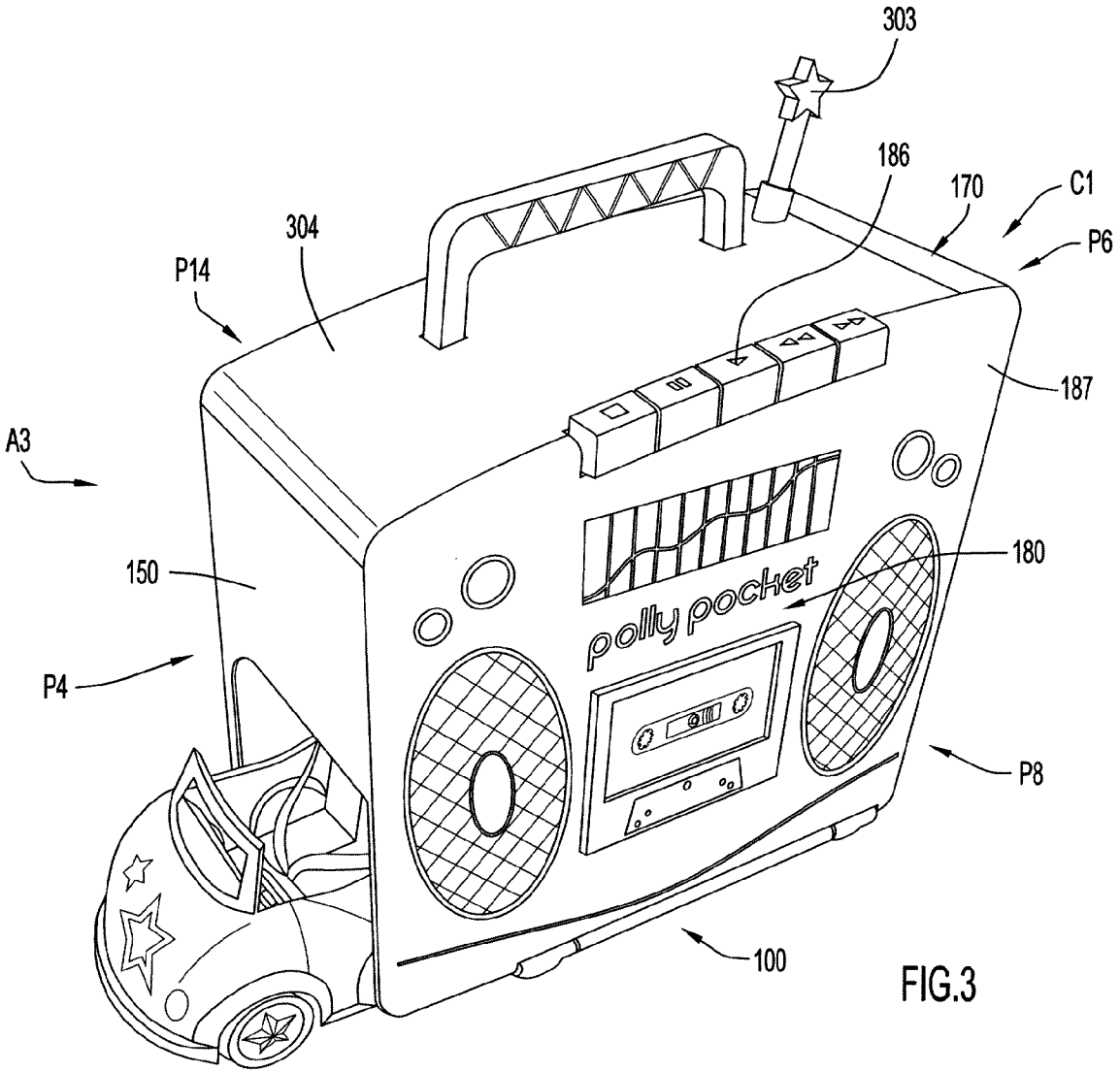
FIG. 3 illustrates a front top perspective view of a playset according to another embodiment disposed in a retracted configuration.
Figure 4:
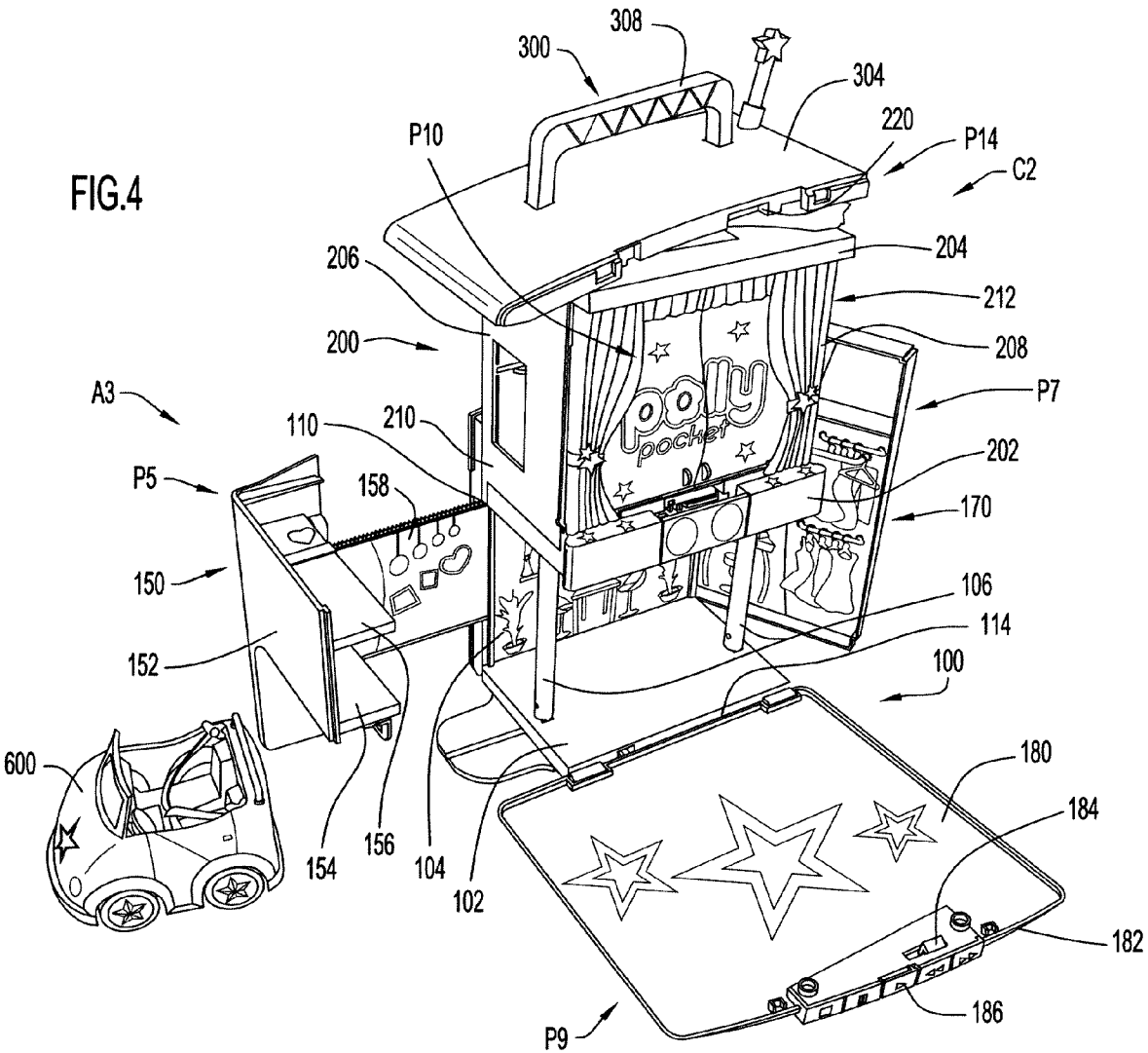
FIG. 4 illustrates a front perspective view of the playset of FIG. 3 disposed in an expanded configuration.
Figure 5:
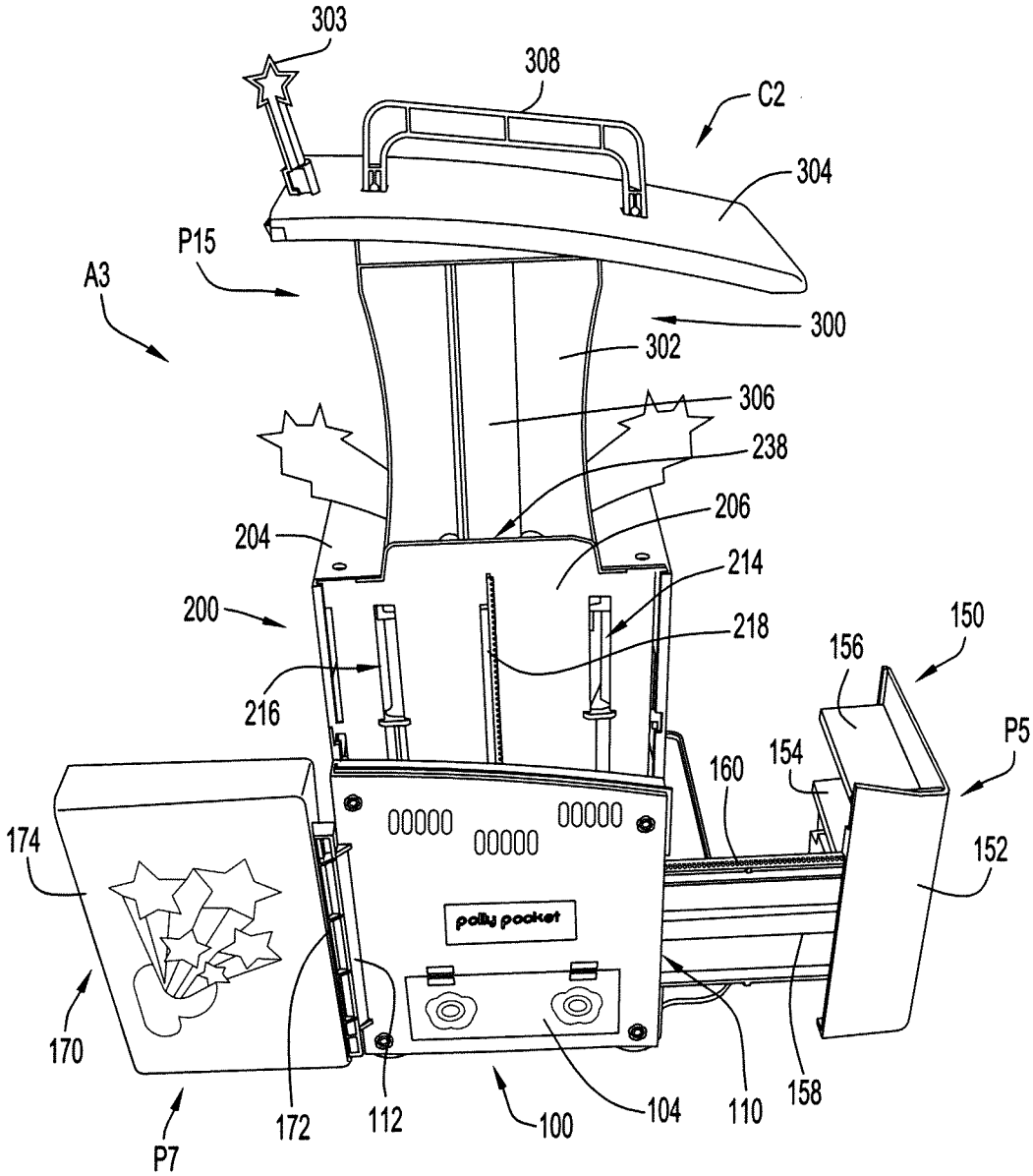
FIG. 5 illustrates a rear perspective view of the playset of FIG. 4.

FIGS. 3, 4 and 5 illustrate perspective views of a playset A3 according to another embodiment. In one embodiment, playset A3 is configured as a "pop-up" or expandable playset. The playset A3 is reconfigurable between a retracted configuration C1 (shown in FIG. 3) and an expanded configuration C2 (shown in FIGS. 4 and 5).

Referring to FIGS. 3 and 4, playset A3 includes a support assembly 100 and a housing 200 movably coupled to the support assembly 100. The housing 200 is movable between a lowered position adjacent to the support assembly 100 such as when the playset A3 is in its retracted configuration C1 (as shown in FIG. 3), and a raised position spaced from the support assembly 100 such as when the playset A3 is in its expanded configuration C2 (as shown in FIG. 4).

Referring to FIG. 4, in one implementation, the support assembly 100 includes a bottom portion 102, an end wall portion 104, and support columns 106. The housing 200 includes a base portion 202 and a top portion 204, an end wall portion 206 and a front wall portion 208, and sidewall portions 210, 212.

Referring to FIGS. 4 and 5, the end wall portion 206 of the housing 200 slidingly engages the end wall portion 104 of the support assembly 100, and the support columns 106 are slidingly received in correspondingly configured openings (not shown) in the base portion 202 of the housing 200. Thus, the housing 200 is slidably movable toward and away from the bottom portion 102 of the support assembly 100.

As shown in FIG. 5, the end wall portion 206 of the housing 200 may include guide slots 214, 216 configured for receiving projections (not shown) provided on the end wall portion 104 of the support assembly 100 for guiding the housing 200 along a linear path of movement between its lowered and raised positions (such as when the playset A3 is reconfigured between its retracted configuration C1 and its expanded configuration C2). Alternatively or in addition, the housing 200 includes a toothed rack 218 extending outwardly from the end wall portion 206. The toothed rack 218 is engaged by a correspondingly configured gear (not shown) coupled to the end wall portion 104 of the support assembly 100, which further aids in guiding the housing 200 along its linear path of movement.

With continued reference to FIGS. 4 and 5, a side assembly 150 is movably coupled to a side edge portion 110 of the end wall portion 104. Another side assembly 170 is movably coupled to an opposing side edge portion 112 of the end wall portion 104.

The side assembly 150 is movable between a retracted position P4 (shown in FIG. 3) adjacent to the support assembly 100 and an extended position P5 (shown in FIGS. 4 and 5) spaced from the support assembly 100. In one embodiment, the side assembly 150 includes an end portion 152 having shelves 154, 156 configured to resemble beds, and a plate 158 coupled to and extending outwardly from the end portion 152. In one implementation, the plate 158 includes a toothed rack 160 (best shown in FIG. 5), which is engaged by a correspondingly configured gear (not shown) coupled to the end wall portion 104 of the support assembly 100. The toothed rack 160 aids in guiding the end portion 152 of the side assembly 150 along a linear path of movement between its retracted position P4 (as shown in FIG. 3) and its extended position P5 (as shown in FIGS. 4 and 5).

The side assembly 170 includes an inner edge portion 172 and a distal edge portion 174. The inner edge portion 172 is pivotally coupled to the side edge portion 112 of the end wall portion 104 of the support assembly 100. The side assembly 170 is thus movable between a closed position P6 (as shown in FIG. 3) adjacent to the support assembly 100 and an extended position P7 (shown in FIGS. 4 and 5) spaced from the support assembly 100.

A front panel 180 is pivotally coupled to a front edge portion 114 of the bottom portion 102 of the support assembly 100. The front panel 180 is movable between a closed position P8 (shown in FIG. 3) adjacent or proximate to the housing 200, and an open position P9 (shown in FIG. 4) spaced from the housing 200. In one embodiment, the front panel 180 includes a distal edge 182 that engages the housing 200 when the housing 200 is in its lowered position adjacent the support portion 100 and the front panel 180 is in its closed position P8. A latch 184 is coupled to the front panel 180 proximate its distal edge 182, which is releasably retained within a correspondingly configured indent 220 provided in the housing 200. Thus, the front panel 180 is retained in its closed position P8 and against the housing 200 when the latch 184 is retained within the indent 220. The latch 184 may be released from the indent 220, such as when a user wishes to pivot the front panel 180 downwardly and into its open position P9, by depressing a release button 186 operatively coupled to the latch 184.

Referring again to FIG. 3, the front panel 180 may include an outer surface 181 stylized to resemble a radio. The playset A3 has a generally rectangular configuration when disposed in its retracted configuration C1. Thus, the stylized outer surface 181 resembles the front face of the radio. Additional decorative elements may be provided on the playset A3, such as a post member 303 extending upwardly from a roof member 304 (described in further detail below), which may be configured to resemble a stylized antenna. Other functional or decorative features may be provided on the playset A3 so that the playset has a particular configuration or theme when disposed in its retracted configuration C1.

Figure 6:
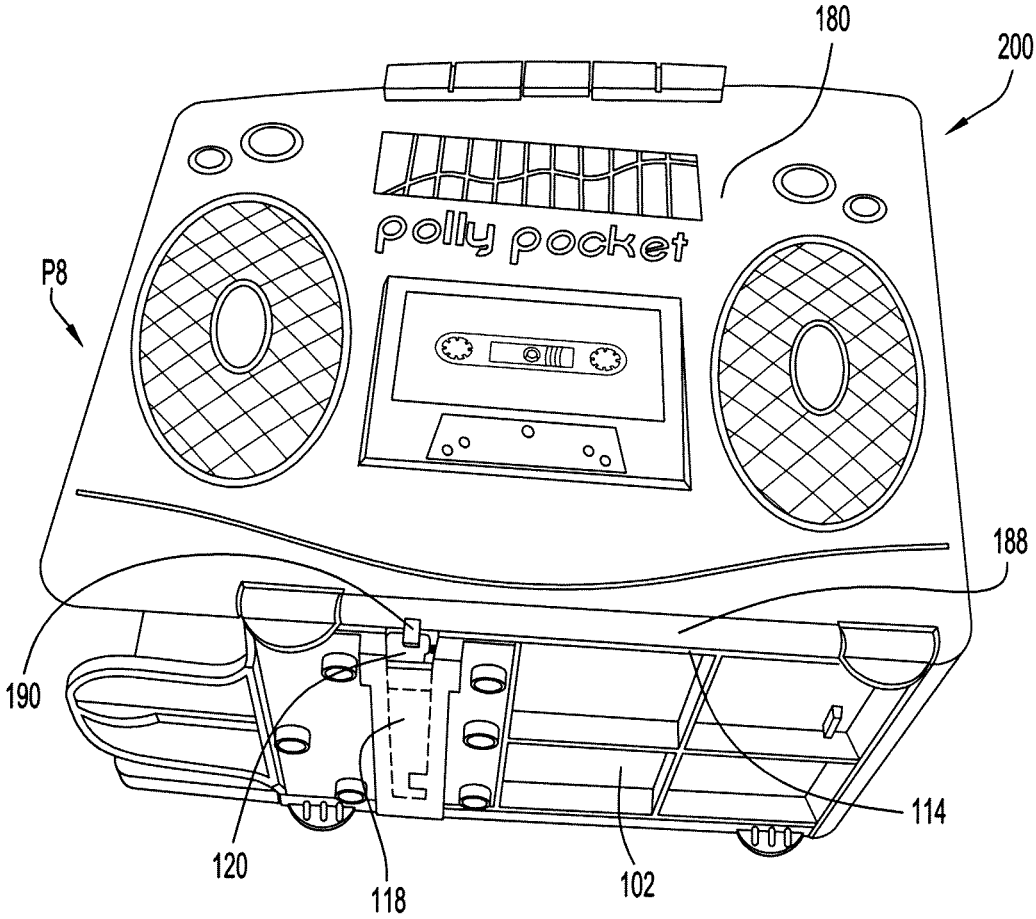
FIG. 6 illustrates a front bottom perspective view of the playset of FIG. 3.

Referring to FIG. 6, in one embodiment, the housing 200 is maintained in its lowered position and/or the side assembly 150 is maintained in its retracted position P4 via a latch 118 (shown in phantom) coupled to the bottom portion 102 of the support assembly 100. The latch 118 may be actuated via movement of a release 120 pivotally coupled to the bottom portion 102 proximate the front edge portion 114 thereof. An edge 188 of the front panel 180 includes a projection 190, which engages the release 120 as the front panel 180 is pivoted downwardly from its closed position P8 to its open position P9 (shown in FIG. 4).

When the release 120 is pivoted due to engagement by the projection 190, the latch 118 in turn is actuated, so that the housing 200 is released from its lowered position and/or the side assembly 150 is released from its retracted position P5. The housing 200 is then biased upwardly to its raised position (as shown in FIGS. 4 and 5) via a resilient member (not shown), such as a compression spring. In addition or alternatively, the side assembly 150 is biased outwardly to its extended position P5 via a resilient member (not shown), such as another compression spring.

Figure 7:
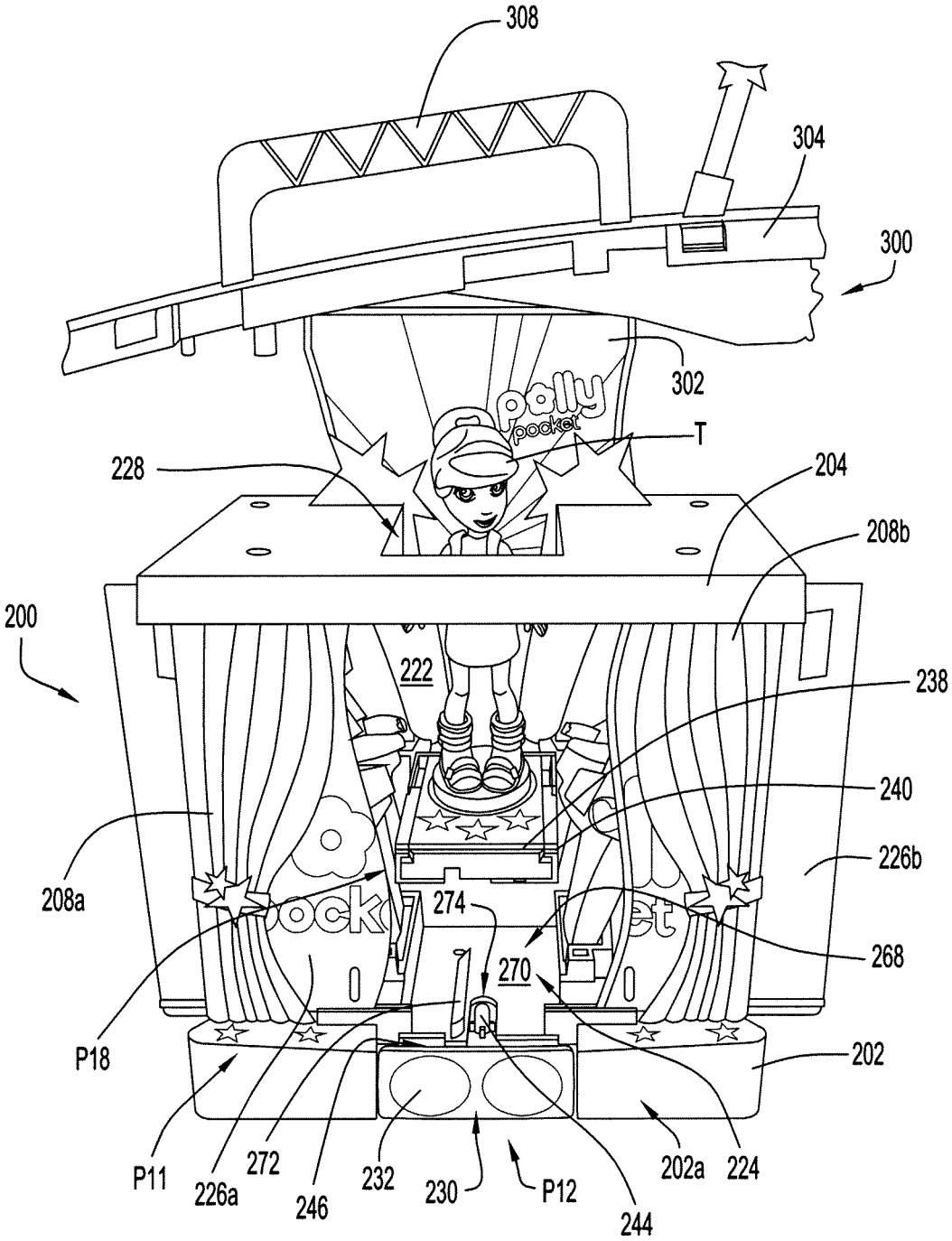
FIG. 7 illustrates a perspective view of a housing of the playset of FIG. 3 showing a platform in a partially raised position.

Referring to FIGS. 4 and 7, the housing 200 defines a chamber 222 configured to receive a doll T therein. The front wall portion 208 defines an opening 224 in communication with the chamber 222. In one implementation, the front wall portion 208 includes a left portion 208*a* and a right portion 208*b*. A door 226*a* is slidably coupled to the left portion 208*a*, and another door 226*b* is slidably coupled to the right portion 208*b*. The doors 226*a*, 226*b* are movable between a closed position P10 (shown in FIG. 4) partially or completely blocking the opening 224, and an open position P11 (shown in FIG. 7) allowing access to the opening 224. The top portion 204 defines another opening 228 also in communication with the chamber 222.

Figure 8:
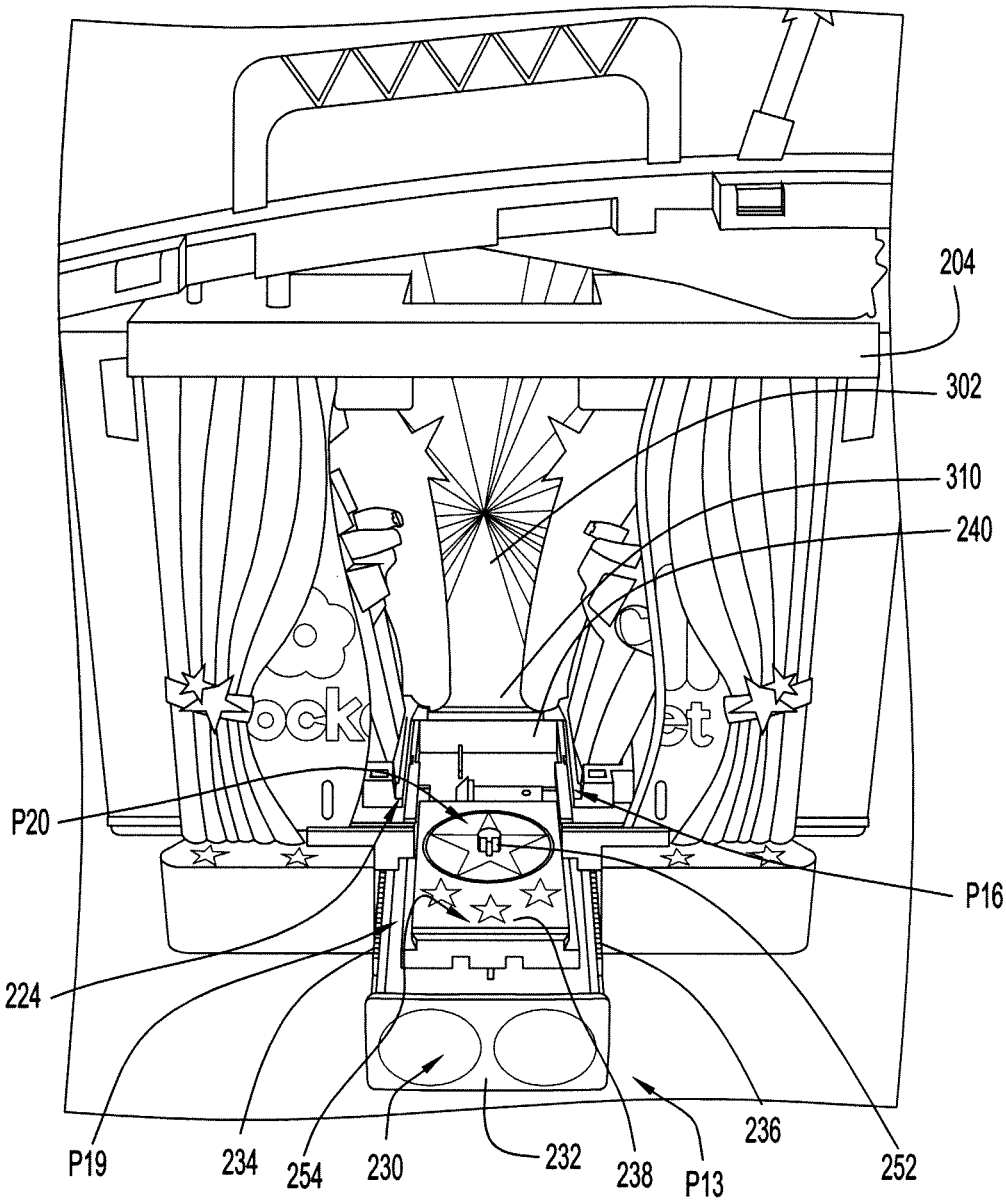
FIG. 8 illustrates another perspective view of the housing of FIG. 7 showing the platform in a lowered and extended position.

Referring to FIGS. 7 and 8, an actuator arm 230 is movably coupled to the base portion 202 of the housing 200. In one implementation, the actuator arm 230 is linearly movable away from and toward the opening 224 in opposing directions D1, D2 (as shown in FIG. 1) between a retracted position P12 (shown in FIG. 7) and an extended position P13 (shown in FIG. 8). The actuator arm 230 includes a distal end face 232 that is proximate to or substantially flush with a front face 202*a* of the base portion 202 when the actuator arm 230 is in its retracted position P12 (as shown in FIG. 7). The distal end face 232 extends outwardly from the front face 202*a* when the actuator arm 230 is in its extended position P13 (as shown in FIG. 8).

With continued reference to FIG. 8, in one embodiment the actuator arm 230 includes toothed side racks 234, 236. Side rack 234 is configured to engage a correspondingly configured gear (not shown) that is operatively coupled to door 226*a*. Similarly, side rack 236 is configured to engage a correspondingly configured gear (not shown) that is operatively coupled to door 226*b*. Upon movement of the actuator arm 230 in direction D1 toward its extended position P13, the side racks 234, 236 engage the corresponding gears and cause the gears to rotate. Rotation of the gears, in turn, causes the doors 226*a*, 226*b* to slide toward their open position P11.

Conversely, upon movement of the actuator arm 230 in direction D2 to its retracted position P12, the side racks 234, 236 cause the gears to rotate in opposite directions. In turn, the doors 226*a*, 226*b* are slid to their closed position P10 (as shown in FIG. 4). Thus, when the actuator arm 230 is moved to its extended position P13, such as when a user pulls the distal end face 232 outwardly and away from the doors 226*a*, 226*b*, access to the opening 224 is permitted.

It should be noted that the doors 226*a*, 226*b* are illustrated in their open position P11 when the actuator arm 230 is in its retracted position P12 so that portions and components within the chamber 222 may be shown and described. However, in one embodiment, in operation the doors 226*a*, 226*b* are automatically moved to their closed position P10 when the actuator arm 230 is in its retracted position P12. In other embodiments, movement of the doors 226*a*, 226*b* is not mechanically linked to movement of the actuator arm 230. For example, another mechanism for triggering the opening or closing of the doors 226*a*, 226*b* may be provided, or the doors 226*a*, 226*b* may be opened or closed manually by a user.

Referring again to FIGS. 4, 5 and 7, the housing 200 includes an upper assembly 300 movable relative to the top portion 204 thereof. In one implementation and as best shown in FIG. 5, the upper assembly 300 includes a back plate 302 slidably coupled to the end wall portion 206, and an upper portion or roof member 304 coupled to the back plate 302. The back plate 302 may include an outwardly extending guide member 306 that is received in and slidably movably along a track 238 provided on the end wall portion 206. In one embodiment, the roof member 304 includes a handle 308 extending upwardly therefrom.

The upper assembly 300 is movable between a lowered position P14 (shown in FIGS. 3 and 4) and a raised position P15 (shown in FIG. 5). For example, a user may grasp the handle 308 and pull the roof member 304 upwardly, thereby causing the back plate 302 to slide upwardly in direction D3 (such as shown in FIG. 1) until the upper assembly 300 is disposed in its raised position P15. From the raised position P15, the user may push downwardly on the handle 308 and/or on the roof member 304, thereby causing the back plate 302 to slide downwardly in direction D4 (as shown in FIG. 1) until the upper assembly 300 is again in its lowered position P14.

Figure 9:
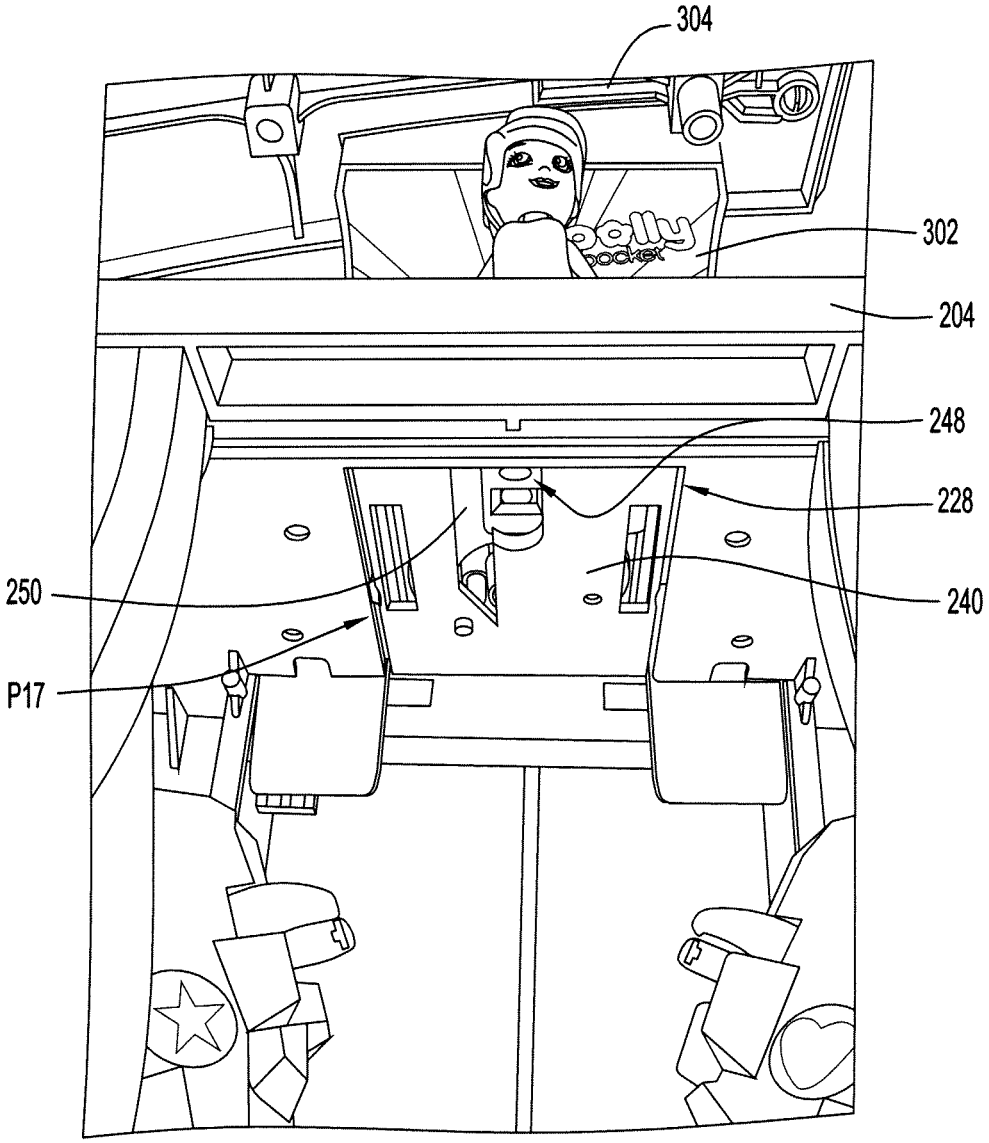
FIG. 9 illustrates another perspective view of portions of the housing of FIG. 7 showing the platform in a raised position.

Referring again to FIGS. 7, 8 and 9, the housing 200 further includes a platform 238 coupled thereto. In one embodiment, the platform 238 is slidably coupled to a frame member 240. The frame member 240 is coupled to a lower end 310 of the back plate 302 (see FIG. 8). Accordingly, the frame member 240 (and thus the platform 238) is linearly movable in opposing directions D3, D4 between a lowered position P16 (shown in FIG. 8) proximate to the base portion 202 and a raised position P17 (shown in FIG. 9) spaced from the base portion 202 as the back plate 302 is moved between its lowered position P14 (shown in FIG. 4) and its raised position P15 (shown in FIGS. 5 and 9). As shown in FIG. 9, the frame member 240 (and thus the platform 238) is received in the opening 228 defined by the top portion 204 when in its raised position P17.

The platform 238 is linearly movable relative to the frame member 240 in opposing directions D1, D2 (such as shown in FIG. 1) between a retracted position P18 (shown in FIG. 7) disposed within the chamber 222 and an extended position P19 (shown in FIG. 8) extending through the opening 224 and out of the chamber 222. Thus, the movement and structure of the platform 238 relative to the frame member 240 is similar to that of a drawer.

Referring to FIG. 7, the actuator arm 230 includes a projection 244 extending upwardly from an upper surface 246 thereof. The projection 244 is receivable in a correspondingly configured opening 248 (shown in FIG. 9), which is provided in an underside 250 of the platform 238. The projection 244 is received in the opening 248, thereby coupling the platform 238 to the actuator arm 230 when the platform 238 is in its lowered position P16 (shown in FIG. 8).

Figure 10:
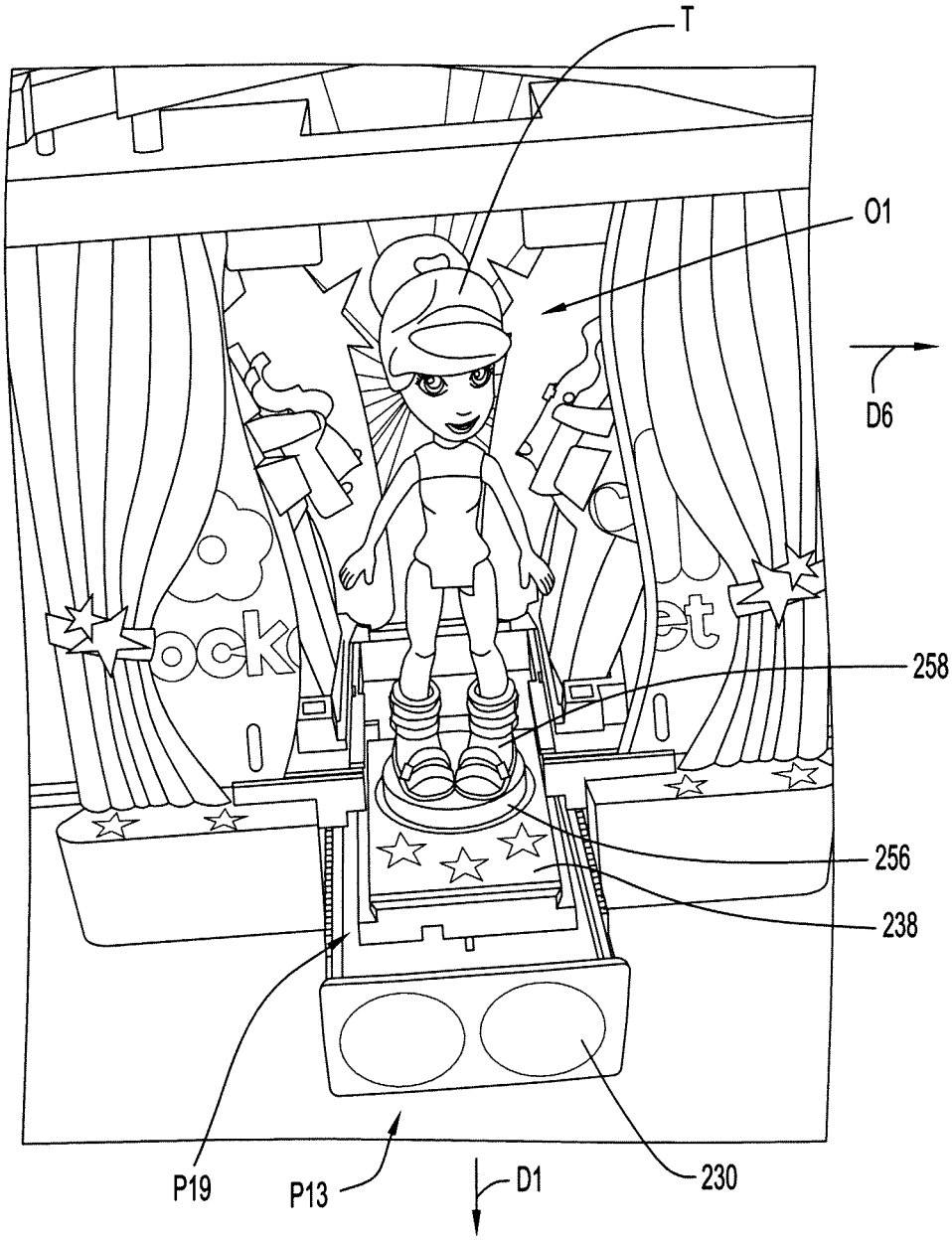
FIG. 10 illustrates a perspective view of portions of the housing of FIG. 7 showing a doll disposed on the extended platform and in a forward facing orientation.
Figure 11:
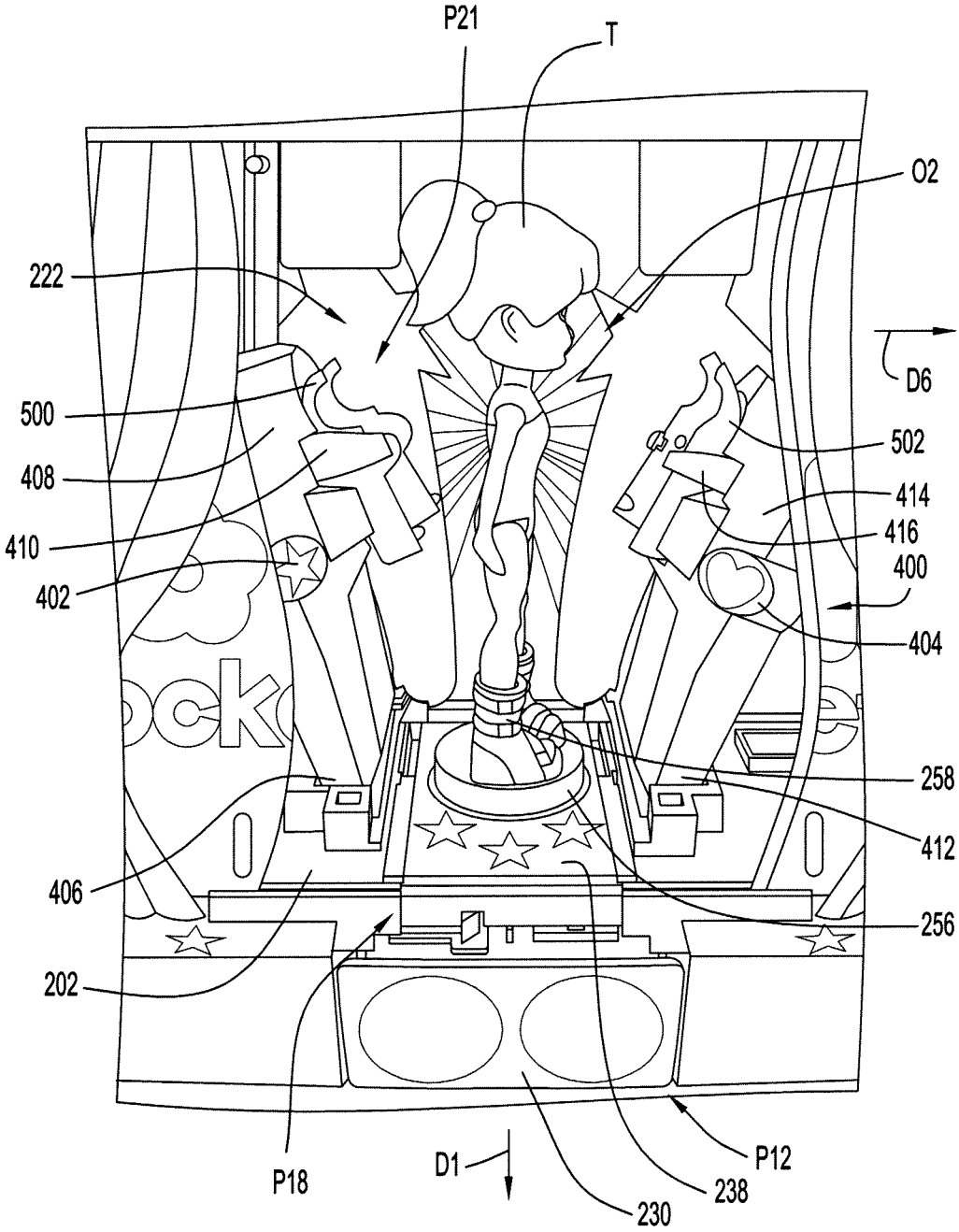
FIG. 11 illustrates a perspective view of portions of the housing of FIG. 7 showing the doll disposed on the retracted platform and in a side facing orientation.

Referring to FIGS. 8, 10 and 11, when the platform 238 is in its lowered position P16 and the actuator arm 230 is pulled outwardly in direction D1 toward its extended position P13, the platform 238 is engaged and pulled outwardly by the projection 244. Thus, the platform 238 is moved through the opening 224 to its extended position P19 outside of the chamber 222. Conversely, as the actuator arm 230 is pushed inwardly in direction D2 toward its retracted position P12, the platform 238 is pushed inwardly by the projection 244 and moved back to its retracted position P18 relative to the frame member 240 and within the chamber 222.

When the platform 238 is moved back to its retracted position P18 (and thus the actuator arm 230 is likewise moved back to its retracted position P12), the platform 238 may be de-coupled from the actuator arm 230. As the platform 238 is moved in direction D3 from its lowered position P16 to its raised position P17, the projection 244 is disengaged from the opening 248 in the platform 238, thereby decoupling the platform 238 from the actuator arm 230, as shown in FIG. 7.

Referring again to FIG. 8, the platform 238 includes an engagement member 252 movably coupled to an upper surface 254 thereof. The engagement member 252 is configured to releasably retain a toy, such as a doll T, as shown in FIGS. 10 and 11. In one implementation, the engagement member 252 is releasably attachable to a coupler 256. The coupler 256, in turn, includes a retaining member 258 releasably securable to the doll T. As illustrated in FIGS. 7, 10 and 11, the retaining member 258 is configured as a pair of boots, which are connected to the coupler 256. The feet of the doll T are received in the boots, thereby releasably securing the doll T to the coupler 256.

The engagement member 252 is rotatable about an axis Y1 (such as shown in FIG. 1) relative to the platform 238 when the platform 238 moves between its extended position P19 (shown in FIG. 10) and its retracted position P18 (shown in FIG. 11). In one embodiment, the axis of rotation Y1 of the engagement member 252 is substantially perpendicular to the plane along which the platform 238 moves in directions D1, D2 (such as shown in FIG. 1). Accordingly, the axis of rotation Y1 of the engagement member 252 is substantially parallel to the plane along which the platform 238 moves in directions D3, D4 (such as shown in FIG. 1).

When the doll T is retained on the engagement member 252, the doll faces outwardly from the chamber 222 in a forward facing orientation O2 and in direction D1 (such as shown in FIG. 1) when the platform 238 is disposed in its extended position P19 (as shown in FIG. 10). The doll T is then rotated (along with the engagement member 252) to a side facing orientation O2 and in direction D6 (as shown in FIG. 1) as the platform 238 moves from its extended position P19 to its retracted position P18 (as shown in FIG. 11). In one embodiment, the engagement member 252 is rotatable about 90° about its axis of rotation Y1 when the platform 238 is moved between its retracted position P18 and its extended position P19. Accordingly, the direction D1 of the forward facing orientation O1 of the doll T is substantially perpendicular to the direction D6 of the side facing orientation O2 of the doll T.

Figure 12:
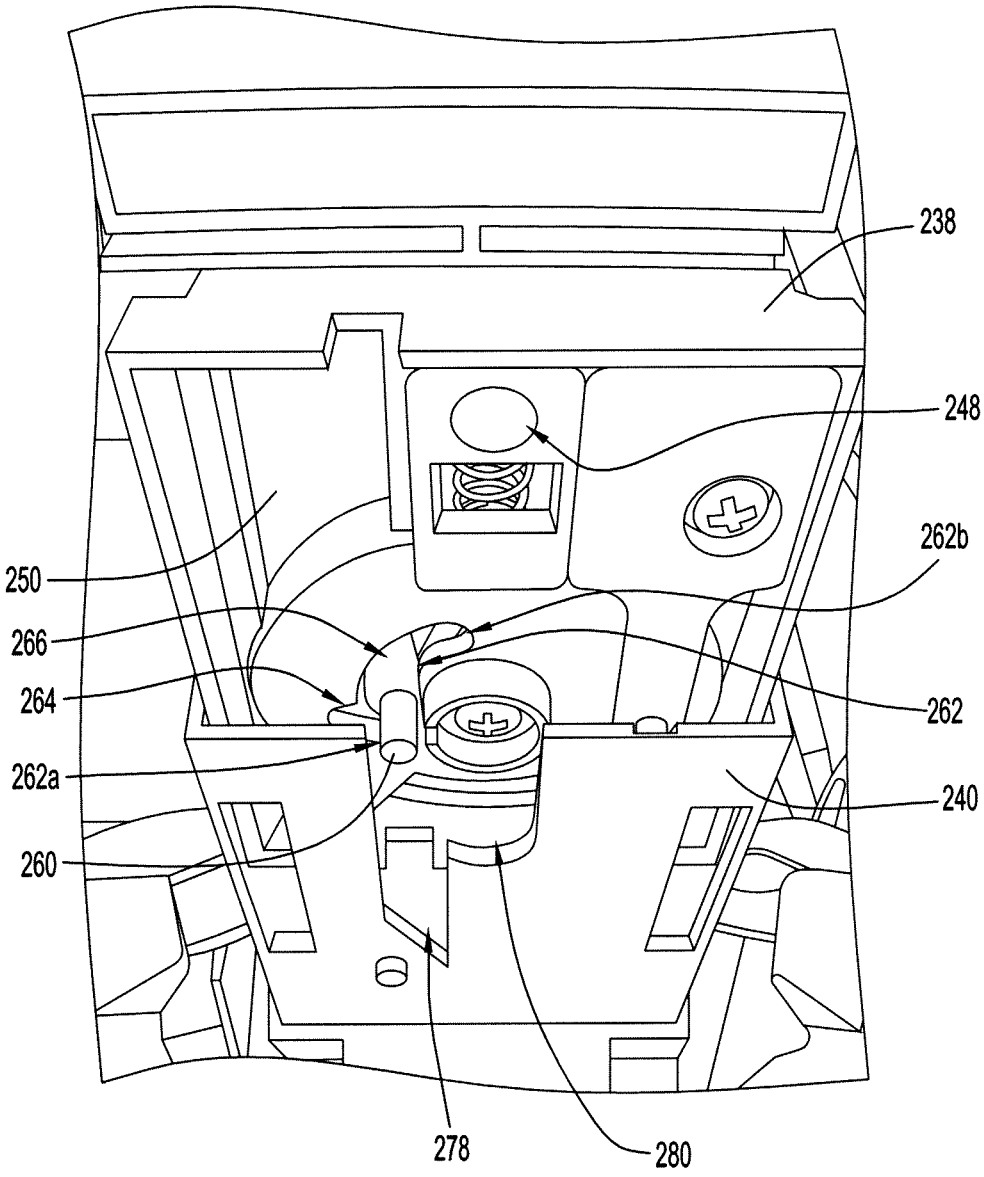
FIG. 12 illustrates a bottom perspective view of the platform in an extended position.

Referring to FIGS. 8 and 12, in one embodiment the engagement member 252 is biased toward an initial position P20 via a resilient member (not shown), such as a spring. When the doll T is disposed on the engagement member 252 (via the coupler 256) and the engagement member 252 is disposed in its initial position P20, the doll T is disposed in its forward facing orientation O1 in direction D1 (as shown in FIG. 10).

Referring to FIG. 12, the engagement member 252 includes a post 260 extending downwardly from the underside 250 of the platform 238. The post 260 is movable along a curved slot 262 provided in the underside 250 and between opposite ends 262*a*, 262*b* thereof. Movement of the post 260 between ends 262*a*, 262*b* of the slot 262 causes the engagement member 252 to rotate between an initial position P20 (corresponding to when the post 260 is disposed at end 262*a*) and a position corresponding to the position of the doll T in its side facing orientation O2 and in direction D6 (as shown in FIG. 11, and corresponding to when the post 260 is disposed at end 262*b*).

End 262*a* of the slot 262 includes a cutout 264. The post 260 is pivotally coupled to the engagement member 252 via an arm 266, so that the post 260 is movable into the cutout 264 from end 262*a*. The post 260 is biased toward end 262*a* via a resilient member (e.g. a spring), but movable into the cutout 264 from end 262*a* against the force of the resilient member. When the post 260 is disposed in the cutout 264, movement of the post 260 along the slot 262 is restricted, and thus rotational movement of the engagement member 252 (and thus the doll T) is restricted.

Figure 13:
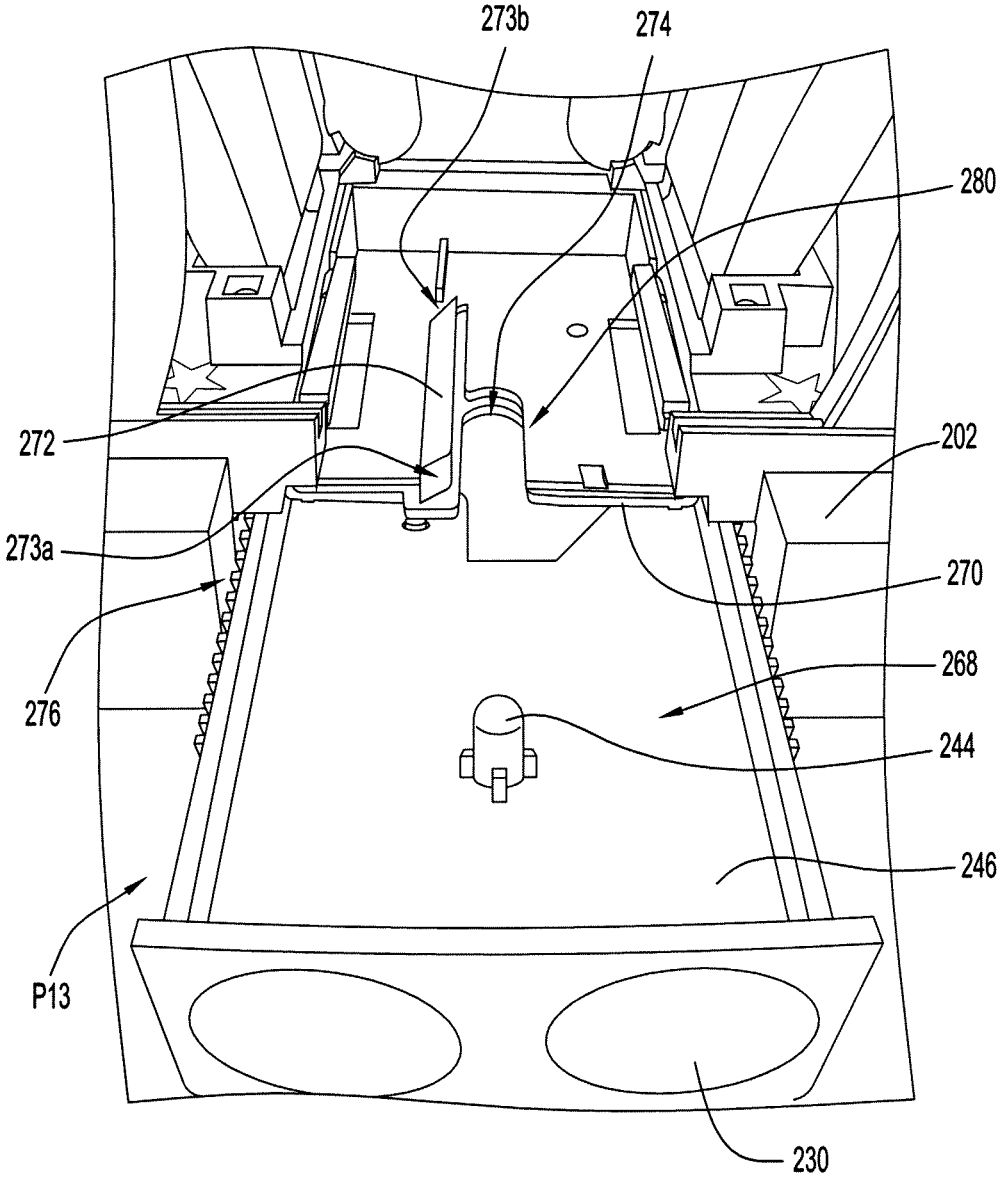
FIG. 13 illustrates a top perspective view of the actuator arm in an extended position.

Referring to FIGS. 7 and 13, the base portion 202 of the housing 200 includes a recessed area 268 (shown in FIG. 7) configured to receive the frame member 240 and the platform 238 when the platform 238 is in its lowered position P16 (as shown in FIG. 8). The recessed area 268 includes a bottom surface 270 and a bar 272 extending upwardly from the bottom surface 270. As shown in FIG. 13, the bar 272 has an end defining a cam surface 273*a* and an opposite end defining another cam surface 273*b*. The bottom surface 270 further includes a cutout portion 274. The actuator arm 230 is slidably disposed in a cavity 276 disposed beneath and partially defined by the bottom surface 270. The projection 244 of the actuator arm 230 extends upwardly from the upper surface 246 thereof and through the cutout portion 274, so that the actuator arm 230 is permitted to slide into and out of the cavity 276 and between its retracted position P12 (shown in FIG. 7) and its extended position P13 (shown in FIG. 13).

Referring to FIGS. 12 and 13, the frame member 240 includes a cutout portion 278 alignable with and configured for accommodating the bar 272. The frame member 240 includes another cutout portion 280 alignable with the cutout portion 274 of the bottom surface 270 of the recessed area 268. The bar 272 is engageable with the post 260, and the projection 244 of the actuator arm 230 is receivable in the opening 248 in platform 238, when the platform 238 is in its lowered position P16 (as shown in FIGS. 10 and 11).

With continued reference to FIGS. 10 and 11, when the platform 238 is disposed in its lowered position P16, the actuator arm 230 may be pulled outwardly from its retracted position P12 to its extended position P13. The platform 238 is thereby moved from its retracted position P18 to its extended position P19. In its extended position P19, the bar 272 is disengaged from the post 260. Accordingly, the post 260 is disposed at end 262*a* (as shown in FIG. 12), and the engagement member 252 is disposed in its initial position P20 (as shown in FIG. 8). Accordingly, the doll T is disposed in its forward facing orientation O1 in direction D1 (as shown in FIG. 10).

The actuator arm 230 may then be pushed inwardly and moved from its extended position P13 back to its retracted position P12, as shown in FIG. 11. Accordingly, the platform 238 is simultaneously moved from its extended position P19 back to its retracted position P18. As the platform 238 is moved to its retracted position P18, the cam surface 273*a* of the bar 272 (shown in FIG. 13) engages the post 260. The angled configuration of the cam surface 273*a* forces the post 260 away from the cutout 264 and pushes the post 260 along the curved slot 262 to end 262*b* thereof. The engagement member 252 is thereby rotated from its initial position P20 to a position oriented with direction D6. Accordingly, the doll T is rotated from its forward facing orientation O1 in direction D1 to its side facing orientation O2 in direction D6, as shown in FIG. 11. The post 260 is maintained in a position proximate to end 262*b* along the slot 262 via engagement with the bar 272. In this way, the engagement member 252 is maintained in its position aligned with direction D6 and the doll T is maintained in its side facing orientation O2.

If the platform 238 is again moved back to its extended position P19 from its retracted position P18 via sliding movement of the actuator arm 230, the bar 272 is again disengaged from the post 260. Once disengaged, the engagement member 252 is biased back to its initial position P20, and the post 260 is moved back to end 262*a* of the slot 262. Accordingly, the doll T is again rotated back to its forward facing orientation O1 in direction D1 (as shown in FIG. 10).

Figure 14:
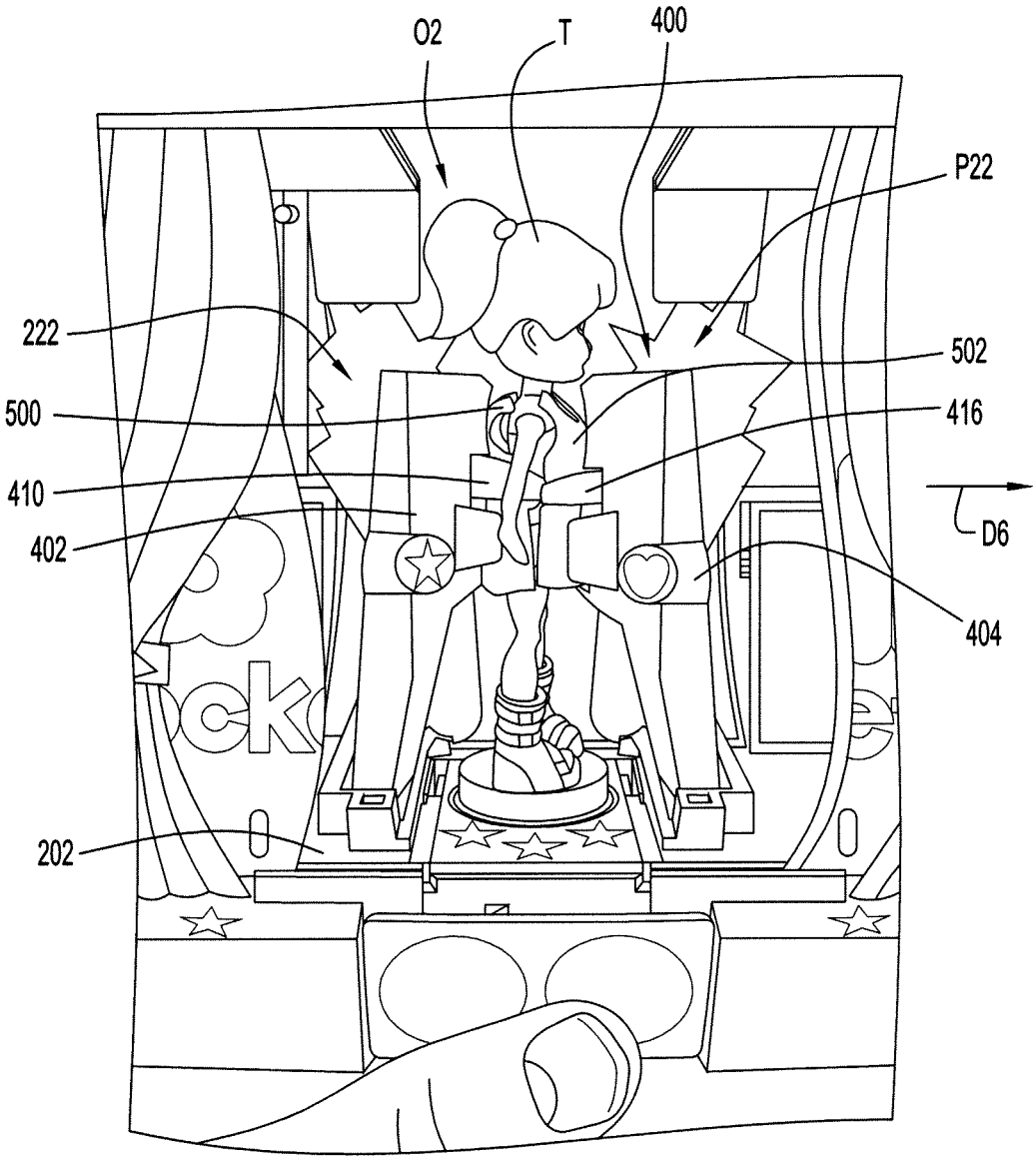
FIG. 14 illustrates another perspective view of portions of the housing of FIG. 7 showing an attachment mechanism in an engagement position engaging the doll.

Referring to FIGS. 11 and 14, in one embodiment, an attachment mechanism 400 is disposed within the chamber 222 of the housing 200. Upon actuation, the attachment mechanism 400 is configured to releasably couple an article, such as dress halves 500, 502, to the doll T when the doll is disposed within the chamber 222 and oriented in its side facing orientation O2 in direction D6.

In one implementation, the attachment mechanism 400 includes pivoting arm assemblies 402, 404 disposed within the chamber 222. Pivoting arm assembly 402 includes a lower end portion 406 pivotally coupled to the base portion 202 and an upper end portion 408. The upper end portion 408 includes grippers 410 configured to releasably retain a dress or garment portion 500. Similarly, pivoting arm assembly 404 includes a lower end portion 412 pivotally coupled to the base portion 202 and an upper end portion 414. The upper end portion 414 includes grippers 416 configured to releasably retain the other garment portion 502.

With continued reference to FIGS. 11 and 14, the upper end portions 408, 414 are pivotally movable between a release position P21 spaced from the doll T (when the doll T is disposed within the chamber 222 and as shown in FIG. 11), and an engagement position P22 proximate to or in contact with the doll T (when the doll T is disposed within the chamber 222 and as shown in FIG. 14). In the release position P21, the garment portions 500, 502 may be retained on the associated grippers 410, 416. In the engagement position P22, the garment portions 500, 502 (or other articles) are decoupled from the grippers 410, 416 and attached to the doll T.

Various mechanism may be employed for coupling the garment portions 500, 502 to the doll T and/or to each other. For example, one of the portions 500, 502 may include a clip or projection that is releasably received in or coupled to a correspondingly configured surface of the other of the halves 500, 502. In other embodiments, articles may be decoupled from the attachment mechanism 400 and coupled to the doll T (or other toy) via hook and loop fasteners, clips, snaps, magnets, etc. Thus, it would be readily understood by one skilled in the art that various mechanisms may be employed for releasably attaching one or more articles to the attachment mechanism 400, and then transferring the articles from the attachment mechanism to the doll T (or other toy) upon actuation of the attachment mechanism (e.g. moving the pivoting arm assemblies 402, 404 from their release position P21 to their engagement position P22).

Figure 15:
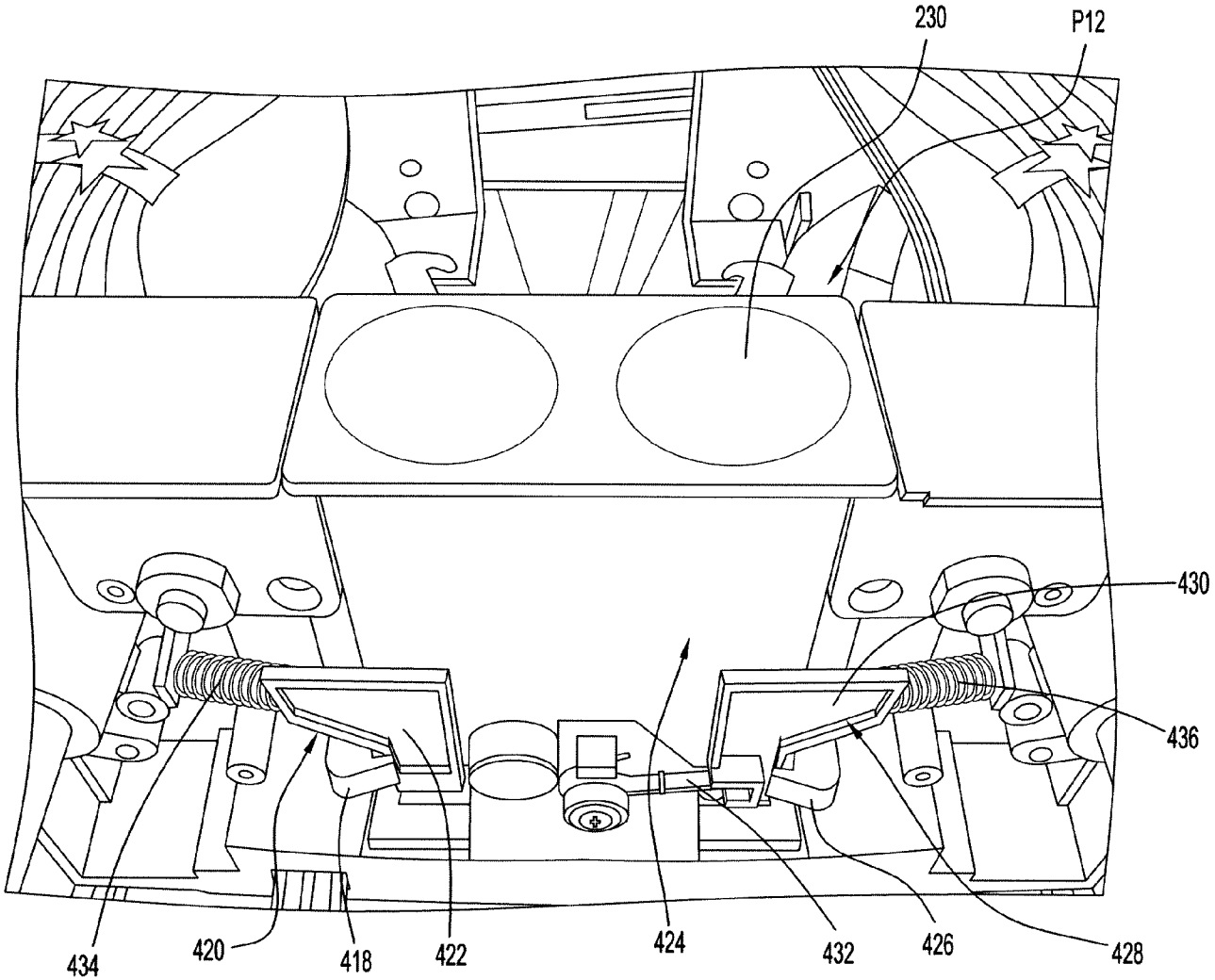
FIG. 15 illustrates a bottom perspective view of the actuator arm in a retracted position and portions the attachment mechanism in a release position.
Figure 16:
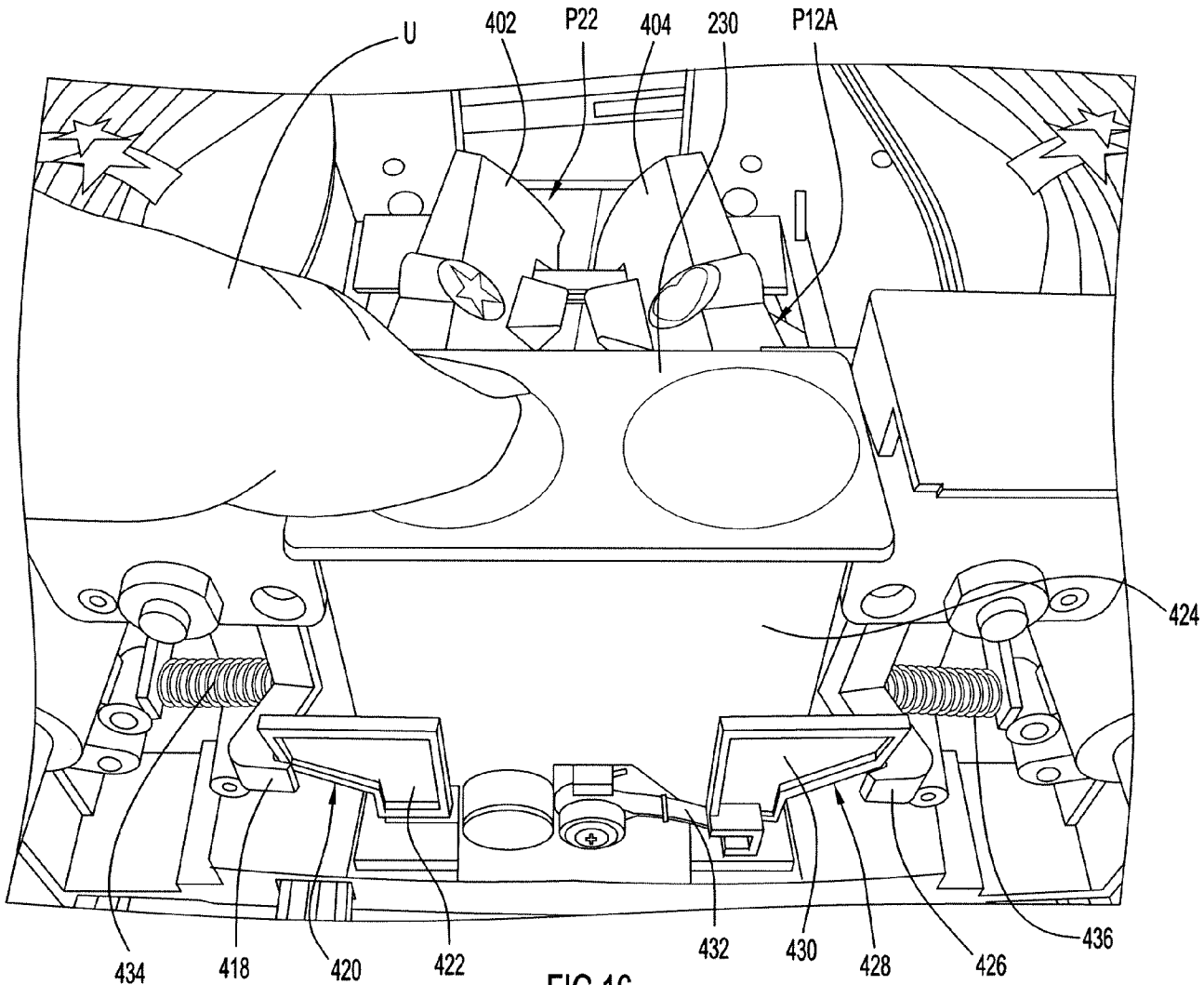
FIG. 16 illustrates a bottom perspective view of the actuator arm in a depressed position and portions of the attachment mechanism in an engagement position.

Referring to FIGS. 15 and 16, in one embodiment, the lower end portion 406 of pivoting arm assembly 402 includes a follower member 418 extending downwardly from the axis about which the pivoting arm assembly 402 pivots. The follower member 418 is engageable with an angled surface 420 of a plate 422 coupled to an underside 424 of the actuator arm 230. Similarly, the lower end portion 412 of pivoting arm assembly 404 includes a follower member 426 extending downwardly from the axis about which the pivoting arm assembly 404 pivots. The follower member 426 is engageable with an angled surface 428 of another plate 430 coupled to the underside 424 of the actuator arm 230.

The actuator arm 230 is movable in direction D2 between its retracted position P12 and a depressed position P12A. As the actuator arm 230 moves from its retracted position P12 to its depressed position P12A, such as when a user U depresses the actuator arm 230, the follower members 418, 426 engage and are pushed outwardly by the corresponding angled surfaces 420, 428 of the plates 422, 430, respectively. The follower members 418, 426 are thereby forced outwardly and away from the actuator arm 230. As a result, the upper end portions 408, 414 of the pivoting arm assemblies 402, 404 are pivoted inwardly from their release position P21 (shown in FIG. 11) to their engagement position P22 (shown in FIGS. 14 and 16).

The actuator arm 230 is biased back to its retracted position P12 from the depressed position P12A via a resilient member 432. In addition, the follower members 418, 426 are biased inwardly and toward the actuator arm 230 via resilient members, such as compression springs 434, 436. Thus, when the user U disengages and releases the actuator arm 230, the pivoting arm assemblies 402, 404 are biased back to their release position P21 (shown in FIG. 11).

Thus, the actuator arm 230 is operative to move the platform 238 into and out of the chamber 222 when the platform 238 is disposed in its lowered position P16, and also operative to actuate the attachment mechanism 400 between its release position P21 and its engagement position P22.

After coupling the garment portions 500, 502 to the doll T (if actuation of the attachment mechanism 400 is implemented), the doll T may be removed from the chamber 222 and/or from the platform 238. In one mode of operation, the doll T may be removed from the chamber 222 through opening 224 in the front wall portion 208 by pulling the actuator arm 230 outwardly to its extended position P13 (thereby moving the platform 238 to its extended position P19), as described above.

Figure 17:
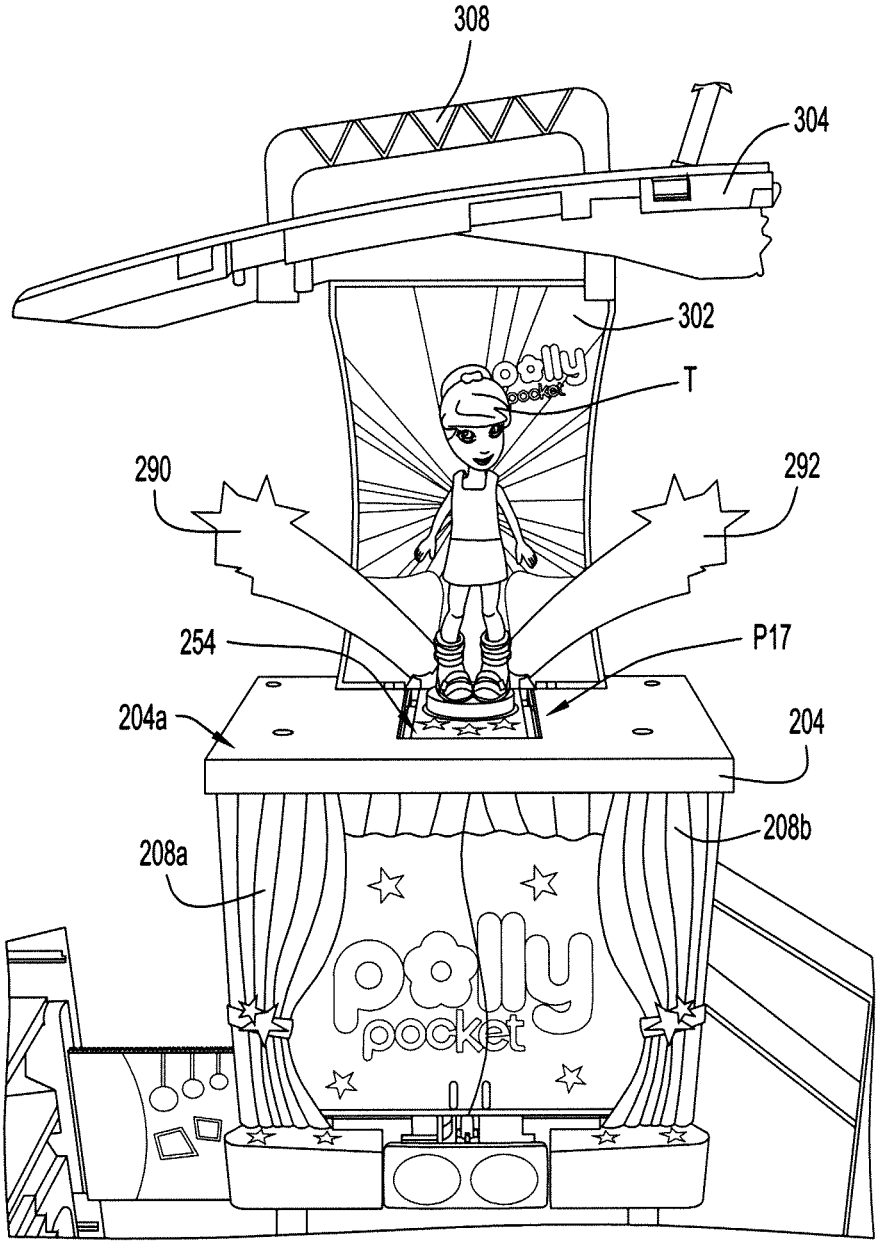
FIG. 17 illustrates another front perspective view of the housing of FIG. 7 showing the platform and doll in a raised position.

Alternatively, the doll T may be removed from the chamber 222 through opening 228 defined by the top portion 204. Referring to FIGS. 7 and 17, the platform 238 (and the doll T coupled thereto) may be moved upwardly in direction D3 from its lowered position P16 to its raised position P17 (shown in FIG. 17). As the platform 238 is moved upwardly in direction D3 and away from the recessed area 268, the platform 238 is separated or disengaged from the bar 272, as described above. As a result, the bar 272 is disengaged from the post 260 and the engagement member 252 is biased back to its initial position P20 (shown in FIG. 8). Accordingly, the doll T is again rotated back to its forward facing orientation O1 in direction D1 as the doll T proceeds upwardly in direction D3 toward the opening 228, as shown in FIG. 7. The platform 238 and doll T may be moved upwardly until the platform 238 is disposed in its raised position P17 proximate to the opening 228 in the top portion 204, such as by pulling upwardly on the handle 308. In one embodiment, the upper surface 254 of the platform 238 is substantially coplanar with a top surface 204*a* of the top portion 204 when the platform 238 is in its fully raised position P17, as shown in FIG. 17.

As the platform 238 is moved downwardly in direction D4 from its raised position P17 back to its lowered position P16, the engagement member 252 is maintained in its initial position P20, and thus the post 260 is disposed in end 262*a*. The doll T is thus maintained in its forward facing orientation O1 in direction D1 as the platform 238 descends in direction D4 to its lowered position P16 within the recessed area 268.

The platform 238 is received in the recessed area 268 as described above. Following the downwardly movement in direction D4, the platform 238 may then be moved in direction D1 from its retracted position P18 to its extended position P19. As the platform 238 is moved outwardly from the chamber 222 in direction D1, the post 260 engages the cam surface 273*b* of the bar 272. The configuration of the cam surface 274*b* is the inverse of the configuration of the cam surface 273*a*. As such, the angled configuration of the cam surface 273*b* forces the post 260 into the cutout 264 (as opposed to along slot 262) as the platform 238 is moved in direction D1. The post 260 is maintained in the cutout 264 via engagement with the bar 272 as the platform 238 is moved in direction D1. The engagement member 252 is thereby maintained in its initial position P20 as the platform 238 moves outwardly to its extended position P19. Accordingly, the doll T is maintained in its forward facing orientation O1 in direction D1.

Thus, the playset A3 (or A1 or A2) allows a doll T to be inserted into a chamber 222 via movement of the platform 238 while disposed in a forward facing orientation O1. The doll T is then rotated to a side facing orientation O2 so that articles (e.g. garment portions 500, 502) may be attached to the doll T. The doll T is may then exit the chamber 222 via movement of the platform 238 and re-rotated back to its forward facing orientation O1 prior to exiting the chamber 222, thus enhancing the play experience for the child. The doll T may exit a lower opening 224, or the doll may be moved upwardly and exit a top opening 228. For example, the doll T may exit the top opening 228 by pulling upwardly on the handle 308 of the upper assembly 300 as described above. The doll T is raised upwardly from the housing 200 and disposed in a forward facing orientation O1, thereby simulating the appearance of a pop star appearing on a stage after dressing in a particular outfit (e.g. via actuation of the attachment mechanism 400, which may be actuated out of view of the child with the doors 226*a*, 226*b* in their closed position P10).

The playset A3 may include additional stylized features conforming to the pop star and/or stage theme. For example and with continued reference to FIG. 17, the left and right portions 208*a*, 208*b* of the front wall portion 208 may be configured as stylized curtains. Pivotally mounted flap elements 290, 292 may be coupled to the back plate 302. The flap elements 290, 292 are pivoted or folded inwardly, and descend along with the back plate 302 and platform 238 when the platform is moved into the chamber 222. When the platform 238 is moved upwardly to its raised position P17, the flap elements 290, 292 pivot outwardly, simulating stars or lights extending outwardly from the doll T retained on the platform 238.

The playset A3 may include additional accessories, such as a vehicle 600 (shown in FIGS. 3 and 4). The vehicle 600 is releasably retained in an opening defined by the side assembly 150 (as shown in FIG. 3), and ejected therefrom when the playset A3 "pops up" from its retracted configuration C1 to its expanded configuration C2 (as shown in FIG. 4).

Additional accessories, such as other articles of toy clothing, purses, furniture, etc. may be provided, and stored within the chamber 222 when the playset A3 is disposed in its retracted configuration C1. In this way, the playset A3 and its accessories may be stored and/or carried in a compact manner.

Referring to FIGS. 18-21, another embodiment of a playset according to the present invention is illustrated. In these figures, an exemplary process of putting clothing onto a toy doll is illustrated.

Figure 18:
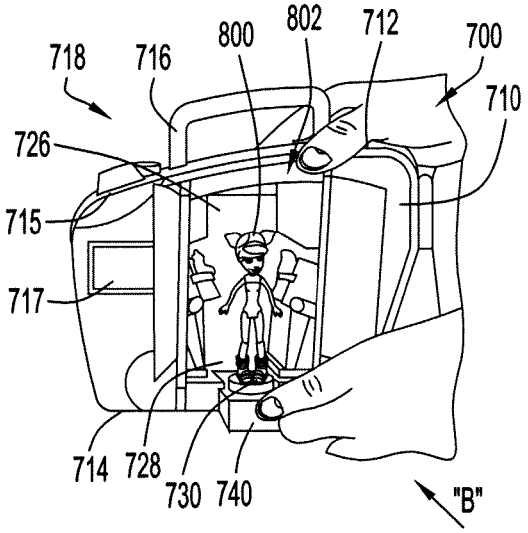
FIGS. 18-21 illustrate front views of another embodiment of a playset in use to place articles onto a doll according to the present invention.
Figure 19:
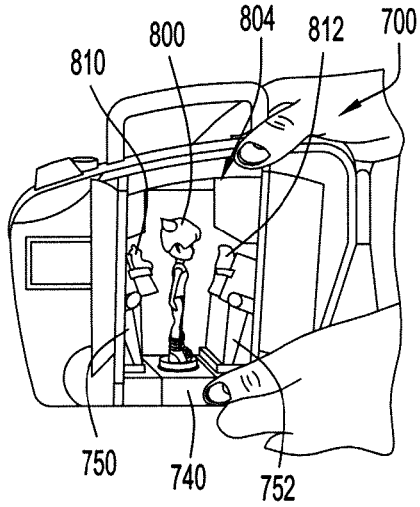
Figure 20:
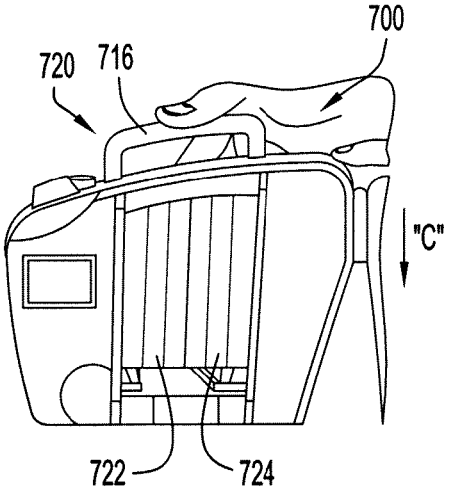

Referring to FIG. 18, the playset 700 includes a housing 710 with an upper side 712 and a lower side 714 is shaped to be placed onto a support surface. The housing 710 also includes a handle 716 that is movably coupled to the housing 710. The handle 716 functions as an actuator that is used to cause the coupling or decoupling of articles, such as toy clothing, to a toy doll in the playset 700.

The housing 710 has an interior region or chamber 728 that is accessible via an opening 726. Doors 722 and 724 (see FIG. 20) are pivotally coupled to the housing 710 and placeable in closed positions as shown, thereby covering or closing the opening 726. The housing 710 also includes a mechanical push button 715 that can be pressed by a child to advance an indexable wheel 217 with indicia thereon. The wheel 217 is rotatably mounted to the housing 710 and is located so that a portion is visible through an opening in the housing 710.

In this embodiment, the housing 700 includes a platform 730 to which a doll 800 can be coupled. The platform 730 includes receptacles that are sized to receive and retain the feet of the doll 800. Proximate to and engaged with the platform 730 is an actuator arm 740. The actuator arm 740 has teeth on its sides that are engaged with a gearing mechanism in the housing 710 that rotates the platform 730 and the doll 800 as shown. As the actuator arm 740 is pushed or moved along the direction of arrow "B" in FIG. 18, the doll 800 moves from a first position or orientation 802 in FIG. 18 to a second position or orientation 804 in FIG. 19 in the housing 710 when actuator arm 740 is pushed inwardly. In orientation 804, the doll 800 is positioned so that a front side of the doll 800 faces arm assembly 752 to which clothing article 812 is coupled and a rear side of the doll 800 faces arm assembly 750 to which clothing article 810 is coupled.

Once the doll 800 is in the housing 710, the handle 716 can be pressed downwardly from its upper position 718 (see FIG. 18) to its lower or actuated position 720 (see FIG. 20) along the direction of arrow "C." The handle 716 is biased upwardly via a biasing mechanism, such as a spring. The movement of the handle 716 along the direction of arrow "C" results in the arm assemblies 750 and 752 moving toward each other on opposite sides of the doll 800 to bring the clothing articles 810 and 812 into engagement to couple the articles 810 and 812 to the doll 800.

Figure 21:
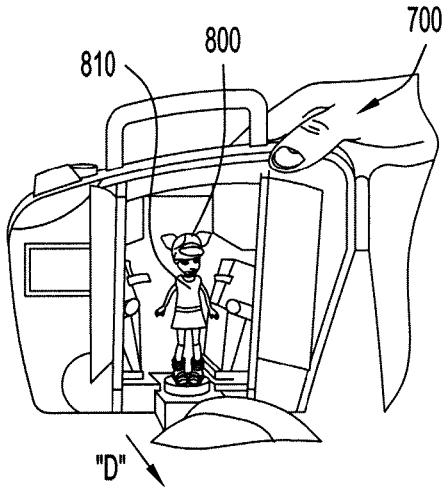

When the handle 716 is released, the doors can be opened and the doll 800 can be moved out of the housing 710 in orientation 802 along the direction of arrow "D" in FIG. 21. As shown in FIG. 21, the clothing articles (only article 810 is visible in this view) are coupled or mounted to the doll 800. In this embodiment, the doll 800 enters an opening of the housing 710 in a first orientation, is repositioned within the housing 710 in a second orientation, the clothing articles are coupled to the doll 800, and the doll 800 exits the same opening of the housing in the first orientation with the clothing articles coupled thereto.

Figure 22:
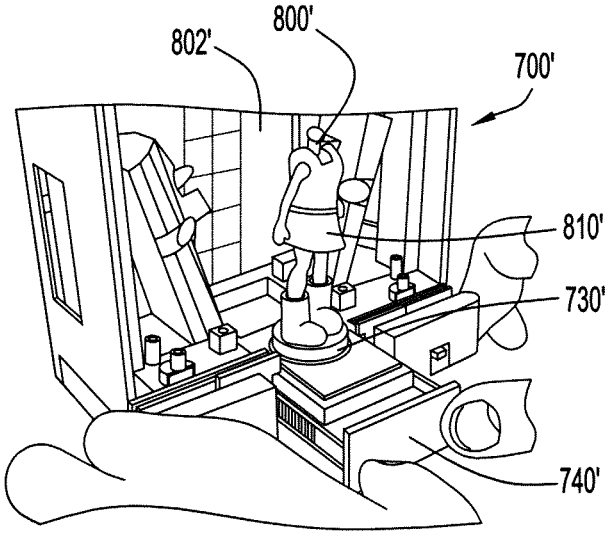
FIGS. 22-24 illustrate front views of another embodiment of a playset in use to remove articles from a doll according to the present invention.
Figure 23:
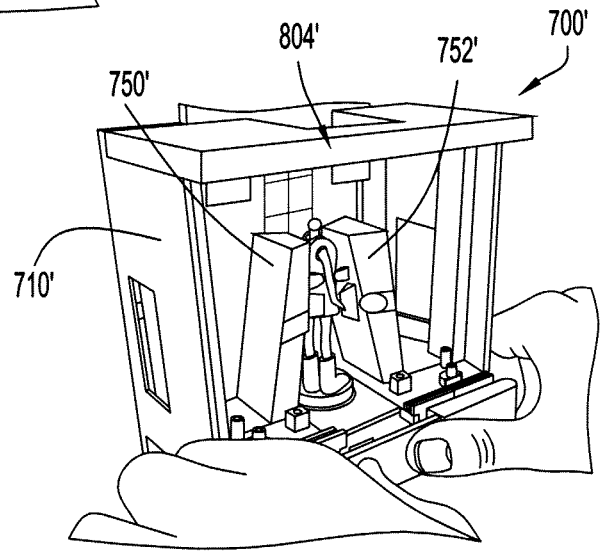
Figure 24:
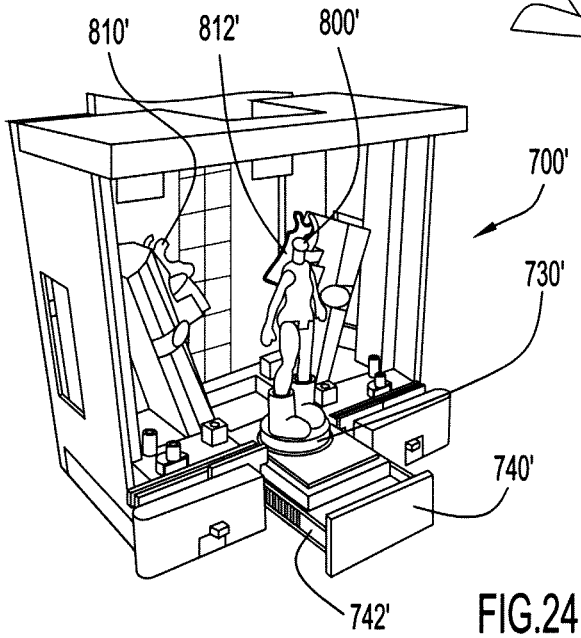

Referring to FIGS. 22-24, an exemplary process of removing clothing articles from a toy doll is illustrated. In this embodiment, a doll 800' with clothing articles (only article 810' is shown) can be positioned onto a platform 730' and moved into a housing 700' while in a first orientation 802'. The platform 730' is moved via an actuator arm 740'. Referring to FIG. 23, as the child continues to push the actuator arm 740' inwardly after the platform 730' and doll 800' are in the housing 710', the arm assemblies 750' and 752' are pivoted toward each other and proximate to the clothing articles on the doll 800', which is in a sideways orientation 804'. The arm assemblies 750' and 752' move via the teeth 742' on the actuator arm 740' and a gearing mechanism in the housing 710'.

Each arm assembly 750' and 752' has engagement arms that can grasp a clothing article on the doll 800'. After the engagement arms grasp a clothing article on its respective side of the doll 800', the user releases the actuator arm 740'. As a result, the arm assemblies 750' and 752' pivot away from each other to their positions shown in FIG. 24. The spaced apart arm assemblies 750' and 752' have clothing articles 810' and 812' coupled to each other. The doll 800' can be moved out of the housing 710' via the actuator arm 740' through the opening with its clothing articles removed. Thus, this housing 700' is useable to quickly change the clothing on a toy doll.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A playset, comprising:

a housing defining a chamber, a first opening in communication with the chamber, and a second opening in communication with the chamber, the housing including a back plate slidably coupled to sidewalls of the housing;

a frame member coupled to the back plate; and a platform slidably coupled to the frame member, such that the platform is movable along a first plane between a first position disposed within the chamber and a second position extending outwardly from the first opening, the platform remaining coupled to the frame member in the second position, and the platform and back plate being movable along a second plane between the first position and a third position proximate the second opening of the chamber.

2. The playset of claim 1, wherein the first plane is substantially perpendicular to the second plane.

3. The playset of claim 1, wherein the housing includes a bottom portion, the platform is coupled to the bottom portion when the platform moves between the first position and the second position, and the platform is decoupled from the bottom portion when the platform moves from the first position to the third position.

4. The playset of claim 3, wherein the bottom portion further comprises:

an actuating arm, the actuating arm being coupled to the platform when the platform moves between the first and second positions via a projection extending into an opening included in an underside of the platform, wherein the platform is decoupleable from the actuating arm when the platform is in the first position in order to allow the platform and frame to move to the third position.

5. The playset of claim 1, wherein the platform includes an engagement member configured to releasably retain a doll, and the engagement member is rotatable about an axis relative to the platform when the platform moves between the first position and the second position.

6. The playset of claim 5, wherein the axis of rotation of the engagement member is substantially perpendicular to the first plane.

7. The playset of claim 5, wherein, when the doll is retained on the engagement member, the doll faces a first direction when the platform is disposed in the second position, and the doll may be rotated in accordance with at least one of the following:

the doll may rotate from facing the first direction to facing a second direction as the platform moves from the second position to the first position; or the doll may rotate from facing the second direction to facing the first direction as the platform moves from the first position to the third position.

8. A playset, comprising:

a housing defining a chamber, a first opening in communication with the chamber, and a second opening in communication with the chamber;

a platform movably coupled to the housing, the platform being movable in opposing first and second directions through the first opening along a first surface of the housing, and the platform being movable in opposing third and fourth directions towards and away from the first surface of the housing and through the second opening; and a doll coupleable to the platform and rotatable about an axis between a first position and a second position relative to the platform, the doll being moved from the first position to the second position as the platform is moved in the second direction or in the third direction.

9. The playset of claim 8, wherein the doll further comprises:

a coupler that is selectively coupleable to the platform, the coupler including a retaining member that removably secures the doll the coupler.

10. The playset of claim 9, wherein the retaining member is a pair of boots and the doll is removably securable within the pair of boots to secure the doll to the coupler.

11. The playset of claim 8, further comprising:

an article releasably attachable to the doll; and an attachment mechanism movably disposed within the chamber, the article releasably coupleable to the attachment mechanism, the attachment mechanism being movable between a third position within the chamber and spaced from the doll and a fourth position within the chamber and proximate the doll when the doll is moved into the chamber along the second direction, the article being decoupleable from the attachment mechanism and attachable to the doll when the attachment mechanism is disposed in the fourth position.

12. The playset of claim 11, wherein the attachment mechanism is moved to the fourth position when the doll is moved to the second position.

13. The playset of claim 11, wherein the attachment mechanism includes first and second arms pivotally coupled to the housing and disposed on opposite sides of the platform, and the first and second arms include distal end portions engageable with opposite sides of the doll.

14. The playset of claim 13, wherein the distal end portion of the first arm is configured to be releasably coupled to a first half of the article and the distal end portion of the second arm is configured to be releasably coupled a second half the article, the first half of the article including a projection that is releasably coupled to a correspondingly configured surface of the second half of the article when the attachment mechanism is disposed in the fourth position.

15. The playset of claim 11, further comprising:

an actuator arm coupled to the platform, the platform being movable in the second direction and into the chamber via movement of the actuator arm in the second direction, and the attachment mechanism being movable from the third position to the fourth position via movement of the actuator arm in the second direction.

16. The playset of claim 15, wherein the platform is decoupled from the actuator arm when the platform is moved in the third direction.

17. A playset, comprising:

a base including an engagement area;

a platform removably coupled to an actuator arm, the actuator arm being coupled to the base and configured to move towards and away from the engagement area in order to move the platform into and out of the engagement area;

a doll releasably retained on the platform;

an attachment mechanism coupled to the base and movable into and out of the engagement area; and an article releasably attachable to the doll, the article being releasably coupleable to the attachment mechanism when the attachment mechanism is disposed out of the engagement area, and the article being decoupleable from the attachment mechanism and attachable to the doll when the attachment mechanism is disposed in the engagement area, the attachment mechanism moving into the engagement area when the actuator arm moves towards the engagement area, the doll facing in a first direction when the platform is disposed out of the engagement area and the actuator arm moving the doll to face in a second direction when the actuator arm is moved towards the engagement area so the article is attached to the doll via the attachment mechanism when the doll is facing the second direction.

18. The playset of claim 17, further comprising:

a housing defining a chamber, a first opening in communication with the chamber, and a second opening in communication with the chamber, the engagement area disposed within the chamber, wherein the platform is movable into and out of the engagement area in opposing third and fourth directions and through the first opening, and the platform is movable into and out of the engagement area in opposing fifth and sixth directions and through the second opening, the platform being coupled to the base when the platform moves through the first opening and the platform being decoupled from the base when the platform moves through the second opening.

19. The playset of claim 18, wherein the first direction is aligned with the fourth direction so that the doll is facing outwardly and away from the engagement area in the first direction.

20. The playset of claim 17, wherein the first direction is substantially perpendicular to the second direction.

* * * * *